US009909321B2

(12) United States Patent
Oliver

(10) Patent No.: US 9,909,321 B2
(45) **Date of Patent: *Mar. 6, 2018**

(54) REVERSIBLE RESILIENT WALL PADDING APPARATUS AND METHODS FOR RELEASABLY ATTACHING SAME TO A WALL

(71) Applicant: SPORTSFIELD INTELLECTUAL, LLC, Delhi, NY (US)

(72) Inventor: Wayne P. Oliver, Delhi, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/860,138

(22) Filed: Sep. 21, 2015

(65) Prior Publication Data

US 2016/0130819 A1 May 12, 2016

Related U.S. Application Data

(63) Continuation of application No. 14/250,585, filed on Apr. 11, 2014, now Pat. No. 9,140,017.

(51) Int. Cl.
*E04F 13/07* (2006.01)
*E04F 13/075* (2006.01)
(Continued)

(52) U.S. Cl.
CPC ..... *E04F 13/075* (2013.01); *E04B 1/40* (2013.01); *E04F 13/0801* (2013.01);
(Continued)

(58) Field of Classification Search
CPC ..... E04F 2290/041; E04F 2290/042; E04F 2290/043; E04F 2290/044; E04F 13/075;
(Continued)

(56) References Cited

U.S. PATENT DOCUMENTS 2,141,700 A 12/1938 Tinnerman
2,240,482 A * 5/1941 Anderson ..... E04H 1/1266 52/239
(Continued)

OTHER PUBLICATIONS

Rail & Fence Top Padding, available from Century Sports Inc., Lakewood, New Jersey, printout available online on Apr. 10, 2014, at http://www.centurysportsinc.com/All_Products/CENTURY_SPORTS/Sports_Fence_Padding/Rail_Fence_Top_Padding.htm, 4-pages, at least s early as Mar. 3, 2011.
(Continued)

*Primary Examiner* — Adriana Figueroa
(74) *Attorney, Agent, or Firm* — Heslin Rothenberg Farley & Mesiti P.C.

(57) ABSTRACT

A reversible resilient wall padding apparatus includes a reversible resilient wall pad and at least one pad connector. The pad includes front, rear, and peripherally-extending sides, and at least one side connector disposed along the peripheral-extending side. The pad connector includes a first portion releasably attachable to the side connector, and a second portion attachable to a vertical surface of a wall. The pad is attachable in a first orientation with the front side facing outwardly and the first portion of the pad connector being attached to the side connector, and the second portion of the pad connector being disposed adjacent to the rear surface of the pad and the vertical surface of the wall, and a second orientation with the rear side of the pad facing outwardly and the first portion of the pad connector being attached to the side connector, and the second portion of the pad connector being disposed adjacent to the front surface of the pad and the vertical surface of the wall.

28 Claims, 15 Drawing Sheets

(51) Int. Cl.

| | |
|---|---|
| ***E04F 13/08*** | (2006.01) |
| ***E04H 3/14*** | (2006.01) |
| ***E04F 13/18*** | (2006.01) |
| ***E04B 1/41*** | (2006.01) |

(52) U.S. Cl.
CPC ..... *E04F 13/081* (2013.01); *E04F 13/0875* (2013.01); *E04F 13/0882* (2013.01); *E04F 13/0883* (2013.01); *E04F 13/18* (2013.01); *E04H 3/14* (2013.01); *E04F 2201/08* (2013.01); *E04F 2290/044* (2013.01)

(58) Field of Classification Search
CPC . E04F 13/26; E04F 13/24; E04F 13/22; E04F 13/0882; E04F 13/30; E04F 2201/08; E04F 2290/04
USPC ..... 52/238.1, DIG. 4, DIG. 13
See application file for complete search history.

(56) References Cited

U.S. PATENT DOCUMENTS 2,262,426 A 11/1941 Hall
2,606,755 A * 8/1952 Samuels ..... E04H 3/14 114/219
2,714,546 A 8/1955 Lesniak
2,833,001 A * 5/1958 Montefalco ..... E04F 13/18 105/422
2,914,873 A 12/1959 Brennan
3,038,571 A 6/1962 Clements
3,173,826 A * 3/1965 Campbell ..... A47B 95/043 156/238
3,378,974 A * 4/1968 Bush, Jr. ..... E04B 9/248 428/47
3,564,801 A * 2/1971 Huerta ..... E04C 2/292 52/309.11
3,609,934 A 10/1971 O'Carroll
3,716,935 A 2/1973 Friederichs
3,856,611 A 12/1974 Markley
3,861,101 A 1/1975 Whisson
3,863,412 A * 2/1975 Bodycomb ..... E04B 2/7457 52/346
3,918,187 A 11/1975 Vogele
3,965,599 A 6/1976 Ebmer
3,986,312 A * 10/1976 Calhoun ..... E04B 2/7457 52/242
4,028,855 A * 6/1977 Prewer ..... E04B 1/6108 52/238.1
4,041,667 A 8/1977 Lindner et al.
4,068,428 A 1/1978 Peterson, III
4,118,903 A 10/1978 Coulthard
4,238,914 A * 12/1980 Omholt ..... E04F 13/0885 52/309.3
4,272,934 A * 6/1981 Cowden ..... E06B 3/28 49/61
4,461,131 A * 7/1984 Pressell ..... E04F 15/02 52/395
4,462,193 A 7/1984 Ericson
4,562,675 A 1/1986 Baigas, Jr. et al.
4,581,865 A 4/1986 Miller
4,635,418 A * 1/1987 Hobgood ..... A47B 47/042 160/135
4,642,926 A 2/1987 Friedman
4,744,189 A 5/1988 Wilson
4,879,854 A * 11/1989 Handler ..... E04B 2/7407 160/135
4,926,609 A 5/1990 Arico
4,934,119 A * 6/1990 Ybarra ..... E04B 2/7409 52/238.1
4,974,384 A 12/1990 Pacione
4,989,688 A * 2/1991 Nelson ..... E04B 1/8227 181/286
5,007,473 A * 4/1991 Evensen ..... A47F 5/105 160/135
5,009,043 A 4/1991 Kurrasch
5,060,443 A 10/1991 Pacione
5,060,752 A * 10/1991 Heiberger ..... E04B 1/8218 181/200
5,111,579 A 5/1992 Andersen
5,129,202 A 7/1992 Payne et al.
5,133,166 A 7/1992 Pacione
5,134,822 A 8/1992 Edlin
5,144,786 A 9/1992 Pacione
5,174,086 A 12/1992 Payne et al.
5,228,857 A 7/1993 Roland
5,249,802 A 10/1993 McCarthy
5,259,163 A 11/1993 Pacione
5,295,342 A 3/1994 Roche et al.
5,384,999 A 1/1995 Roche et al.
5,606,841 A * 3/1997 Carter, Jr. ..... E04B 2/7448 52/311.2
5,622,504 A 4/1997 Hance
5,647,154 A 7/1997 Groves
5,682,695 A 11/1997 Hoffman
5,778,580 A 7/1998 Zarelius
5,974,753 A * 11/1999 Hsu ..... E04F 13/0862 52/287.1
5,993,287 A * 11/1999 Melashenko ..... E04H 15/008 160/135
6,000,983 A 12/1999 Pressman et al.
6,010,387 A 1/2000 Nemec et al.
6,065,258 A 5/2000 McClatchy
6,126,551 A * 10/2000 Martin ..... A63C 19/10 472/90
6,132,666 A 10/2000 Foley et al.
6,367,218 B2 4/2002 Lombardo
6,701,677 B2 3/2004 Gresham et al.
6,751,915 B2 6/2004 Crowley
7,160,600 B2 1/2007 Shepard et al.
7,665,810 B2 2/2010 Crompton et al.
7,727,609 B1 * 6/2010 Crasno ..... A63B 6/00 428/100
8,082,696 B2 12/2011 Oliver et al.
8,316,612 B2 11/2012 Dickens
8,407,955 B2 4/2013 Delforte
8,424,249 B2 4/2013 Oliver
8,500,940 B2 8/2013 Shepard et al.
8,511,014 B2 8/2013 Delforte
8,555,585 B2 10/2013 Dickens
9,140,017 B1 9/2015 Oliver
2006/0166002 A1 * 7/2006 Grey ..... B44F 7/00 428/413
2010/0132267 A1 6/2010 Fletcher
2011/0254306 A1 * 10/2011 Nelson ..... B60R 13/0815 296/39.1
2012/0321880 A1 * 12/2012 Millar ..... E04H 4/14 428/319.3
2013/0111840 A1 5/2013 Bordener
2013/0269273 A1 * 10/2013 Mayo ..... E04F 13/0862 52/391

OTHER PUBLICATIONS

Top Rail Pad, Guard Rail Pad, and Fence Post Pad, available from SportsGraphics of Clarion, Iowa, pp. 7-9 of 2013 FieldWallPads.com Catalog by SportsGraphics, 17-pages, at least as early as Aug. 25, 2013.

Plywood Backed Wall Padding, Sewn Wall Pads, and Rail Cap, available from ci-Fabrics of San Diego, California, printout available online on Feb. 6, 2014, at http://www.cifabrics.com/football-pads.html, 1-page, at least as early as Feb. 6, 2014.

* cited by examiner

REVERSIBLE RESILIENT WALL PADDING APPARATUS AND METHODS FOR RELEASABLY ATTACHING SAME TO A WALL

CROSS-REFERENCE TO RELATED APPLICATION

This patent application is a continuation of U.S. patent application Ser. No. 14/250,585, filed Apr. 11, 2014, and entitled "Reversible Resilient Wall Padding Apparatus And Methods For Releasably Attaching Same To A Wall", which issued on Sep. 22, 2015, as U.S. Pat. No. 9,140,017, the entire subject matter of this application being incorporated herein by reference.

FIELD OF THE DISCLOSURE

The present disclosure relates generally to wall padding, and more particularly to reversible resilient wall padding apparatus and methods for releasably attaching reversible resilient wall padding apparatus to a wall.

BACKGROUND

Outdoor stadium wall padding has been a fixture since the 1970's, protecting athletes at all levels from dangerous impacts with solid wood and/or concrete walls. The padding is typically constructed of 3 materials, a ¾-inch plywood backer board, a 3-inch polyurethane foam padding adhered to the board, and a laminated or coated UV resistant vinyl cover.

U.S. Pat. No. 8,082,696, issued to Oliver et al., and U.S. Pat. No. 8,424,249, issued to Oliver, disclose a temperature compensating outdoor wall padding apparatus, which in one embodiment includes a rigid backing, padded material, and incorporates a stretch fabric into the edges of a vinyl cover to provide a tension on the vinyl cover minimizing the possibility of wrinkling of the vinyl cover due to a change in temperature. In another embodiment, the temperature compensating outdoor wall padding apparatus employs a rigid backing, padded material, a resilient cover, stretchable in 4 directions and pre-tensioned to provide tension on the resilient cover minimizing the possibility of wrinkling of the resilient cover due to a change in temperature. Z-shaped clips are attached to and extend horizontally across rear side of the backing and cooperate with corresponding horizontally disposed Z-shaped clips attached to a fence or wall of a stadium.

Conventional safety fence and railing padding attach to a fence. Such safety pads have a generally curved, U-shaped, or L-shaped cross-section that are positionable horizontally over the top rail of a fence. Such safety pads include grommets for securing the safety pad to the top of the fence with cable ties. Other safety pads, attachable in front of the poles supporting the fence, have a rear portion defining outwardly extending flaps with grommets that are secured with cable ties.

U.S. Pat. No. 4,744,189, issued to Wilson, discloses a removable wall panel which includes a decorative wall panel having a fabric covering on a board removably secured to an existing wall. The rear of the board carries a plurality of "VELCRO" fasteners for cooperation with corresponding fasteners on the wall. The panels may be easily secured to the wall, such as a drywall partition, and may be easily removed whenever desired.

There is a need for further wall padding, and more particularly to reversible resilient wall padding apparatus and methods for releasably attaching reversible resilient wall padding apparatus to a wall.

SUMMARY

In a first aspect, the present disclosure provides a reversible resilient wall padding apparatus releasably attachable to a vertical surface of a wall. The reversible resilient wall padding apparatus includes a reversible resilient wall pad and at least one pad connector. The reversible resilient wall pad includes a front side, a spaced-apart rear side, and a peripherally-extending side disposed between the front side and the rear side, and at least one resilient side connector disposed along the peripheral-extending side. The at least one pad connector includes a first portion releasably attachable to the at least one resilient side connector, and a second portion attachable to the vertical surface of wall. The reversible resilient pad is attachable to the vertical surface of the wall in a first orientation with the front side of the reversible resilient pad facing outwardly from the vertical surface of the wall and the first portion of the pad connector attached to the at least one resilient side connector disposed along the peripheral extending side of the reversible resilient pad, and the second portion of the pad connector being disposed adjacent to the rear surface of the reversible resilient pad and the vertical surface of the wall. The reversible resilient pad is attachable to the vertical surface of the wall in a second orientation with the rear side of the reversible resilient pad facing outwardly from the vertical surface of the wall and the first portion of the pad connector being attached to the at least one resilient side connector disposed along the peripheral extending side of the reversible resilient pad, and the second portion of the pad connector disposed adjacent to the front surface of the reversible resilient pad and the vertical surface of the wall.

In a second aspect, the present disclosure provides a method for releasably attaching a reversible resilient wall padding apparatus to a vertical surface of a wall. The method includes providing a reversible resilient wall pad comprising a front side, a spaced-apart rear side, and a peripherally-extending side disposed between the front side and the rear side, attaching the reversible resilient wall pad to the wall in a first orientation by supporting portions of the peripherally-extending side of the reversible resilient wall pad from the wall so that the front side of the reversible resilient pad is disposed vertically and faces outwardly, detaching the reversible resilient wall pad from the wall, and attaching the reversible resilient wall pad to the wall in a second orientation by supporting portions of the peripherally-extending side of the reversible resilient wall pad from the wall so that the rear side of the reversible resilient pad is disposed vertically and faces outwardly.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

Figure 1:
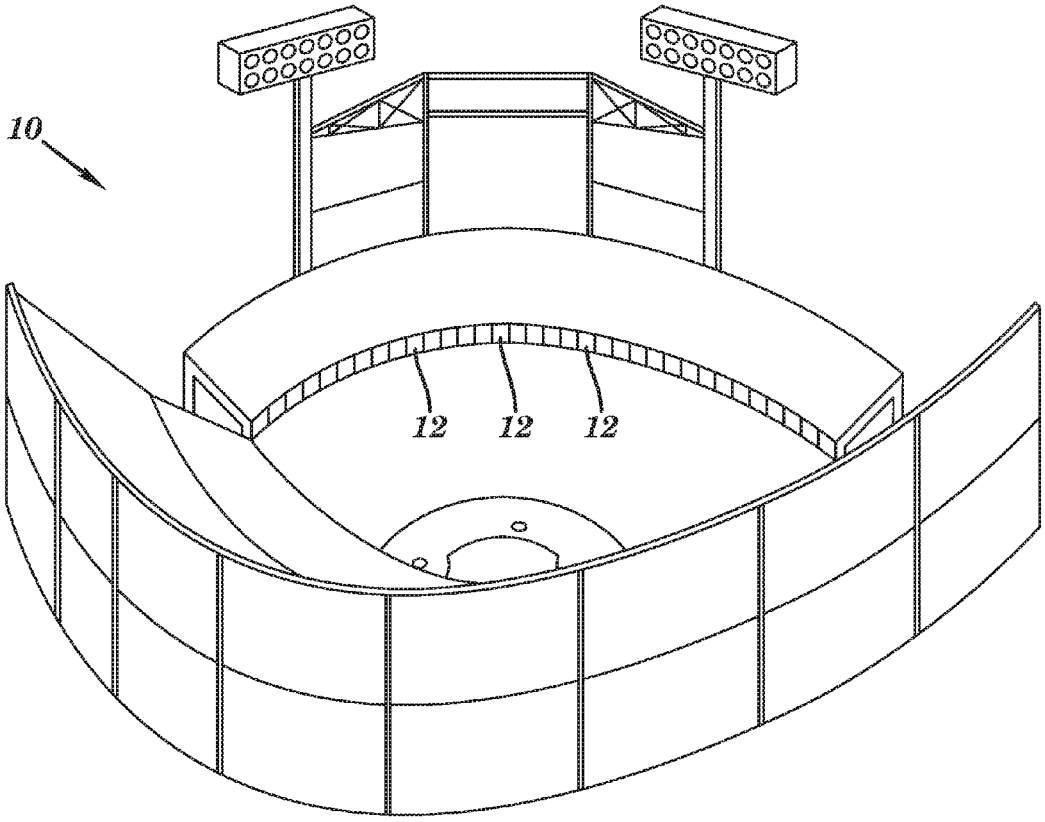
FIG. 1 is a perspective view of a stadium having a plurality of reversible resilient wall padding apparatus in accordance with aspects of the present disclosure.
Figure 2:
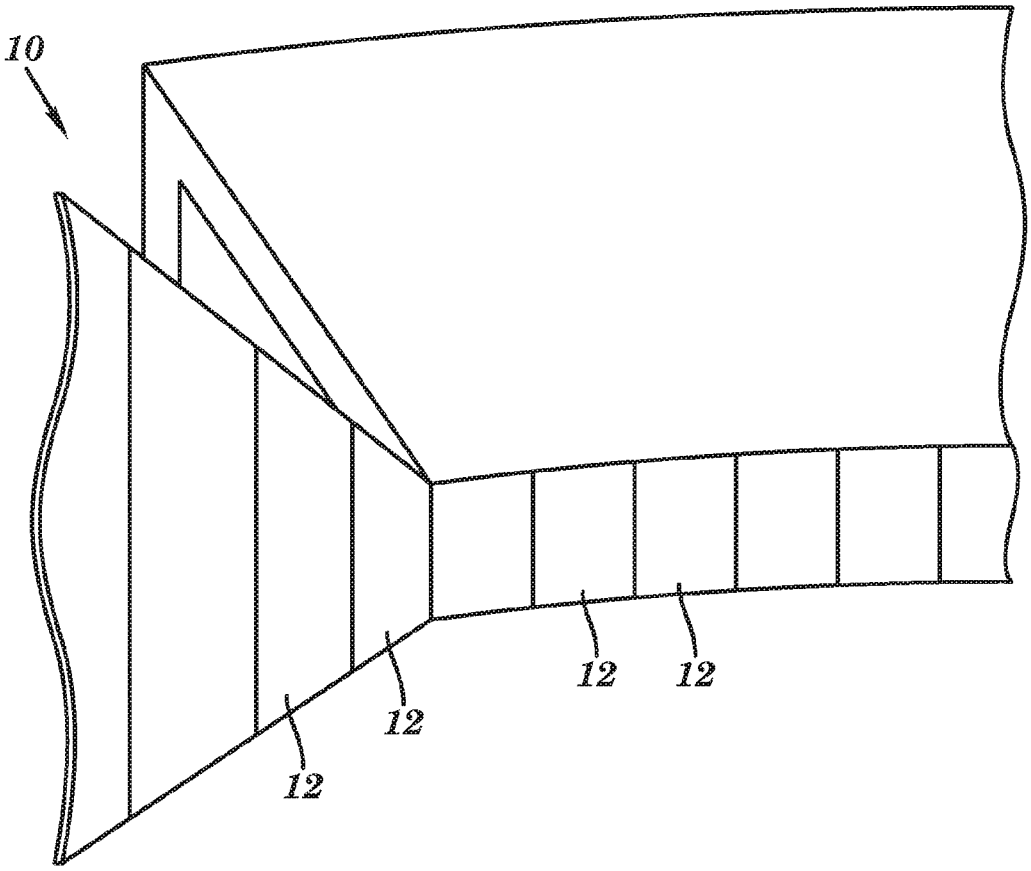
FIG. 2 is an enlarged perspective view of some of the plurality of reversible resilient wall padding apparatus of FIG. 1.

FIGS. 1 and 2 illustrate one embodiment of an exemplary outdoor stadium 10 having a plurality of reversible resilient wall padding apparatus 12 disposed side-by-side along the field of the stadium in accordance with the present disclosure.

In aspects of the present disclosure, the reversible resilient wall padding apparatus may incorporate a reversible resilient wall pad and at least one pad connector or pad connector means so that the reversible resilient wall pad is releasably attachable to a support structure with either of its main sides or surfaces facing outwardly. For example, as described in greater detail below, a reversible resilient wall pad may include cover, a resilient core, and one or more resilient side connectors, and the pad connector may comprise one or more pad connector straps or pad connector tabs. The pad connectors may act as intermediate connectors operably attachable to the peripherally-extending side of the reversible resilient wall pad and operably attachable to a vertical surface of a wall. For example, the resilient side connectors may comprise fasteners that cooperate with corresponding or substantially aligned resilient fasteners on the pad connectors. The pad connectors may be attached to a vertical surface of a wall or comprise fasteners that cooperate with corresponding or substantially aligned fasteners on the vertical surface of the wall. The reversible resilient wall pad may be easily secured to the vertical surface of the wall, and may be easily removed, reversed or flipped around and, easily resecured to the vertical surface of the wall.

Such a technique of the present disclosure of the reversible resilient wall padding apparatus may eliminate the rigid backing board found in conventional outdoor wall padding. In addition, the reversible resilient wall padding apparatus may increase the life of the wall pad as both main surfaces or sides may be employed compared to conventional wall padding in which only one side is usable. Further, the reversible resilient wall padding apparatus may include a reversible resilient wall pad having a resilient cover which is pre-tensioned. In addition, the reversible resilient wall padding apparatus may include a reversible resilient wall pad having a resilient cover which is pre-tensioned to provide a tension on the cover to minimize the possibility of wrinkling of the cover due to a change in temperature.

Figure 3:
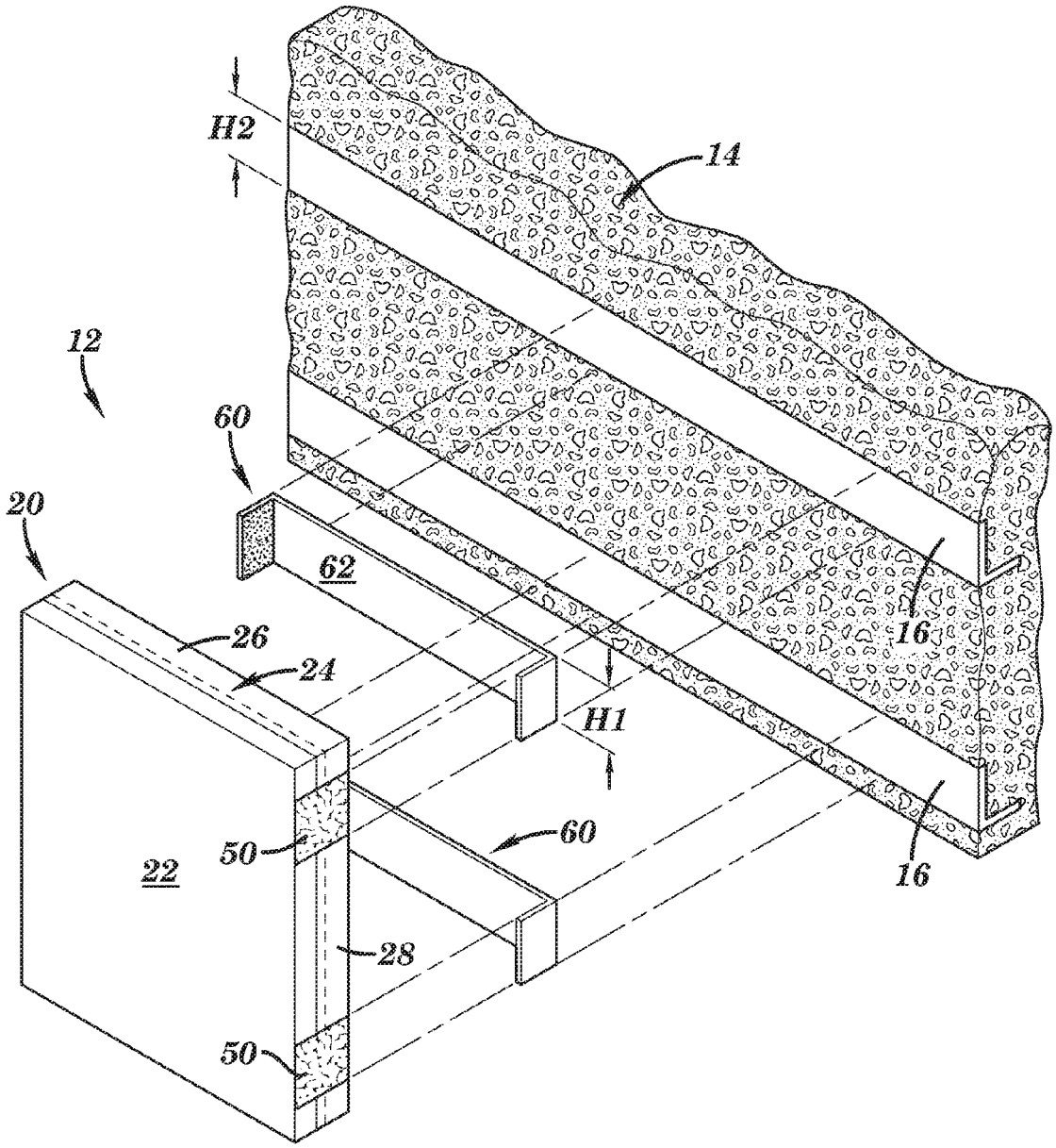
FIG. 3 is an enlarged, exploded, perspective view of one of the plurality of reversible resilient wall padding apparatus of FIG. 1 releasably attachable to a vertical surface of a wall.

FIG. 3 illustrates an exploded view of reversible resilient wall padding apparatus 12 which generally includes a reversible resilient wall pad 20 and one or more pad connectors or pad connector straps 60. In this illustrated embodiment, the pad connector straps are releasably attachable to the reversible resilient wall pad and may also be releasably attachable to a vertical surface of a wall 14. For example, as disclosed further below, pad connector straps 60 may be releasably attachable to reversible resilient wall pad 20 via hook-and-loop fasteners, and pad connector straps 60 may be releasably attachable to the vertical surface of wall 14 via a magnetic strip magnetically attachable to a wall connector such an embedded metallic member 16.

Reversible resilient wall pad 20 may generally include a main front surface or side 22, a main rear surface or side (not shown in FIG. 3), and a peripherally-extending surface or side 24 disposed between front side 22 and the main rear side. Peripherally-extending side 24 may include a horizontal top side 26, a horizontal bottom side (not shown in FIG. 3), a vertical right side 28, and a vertical left side (not shown in FIG. 3). In this illustrated embodiment, the reversible resilient wall pad may be generally rectangular such as in the form of a cuboid or rectangular prism. The front side and the rear side may be generally evenly spaced apart so that the releasable pad has a generally constant thickness.

Figure 4:
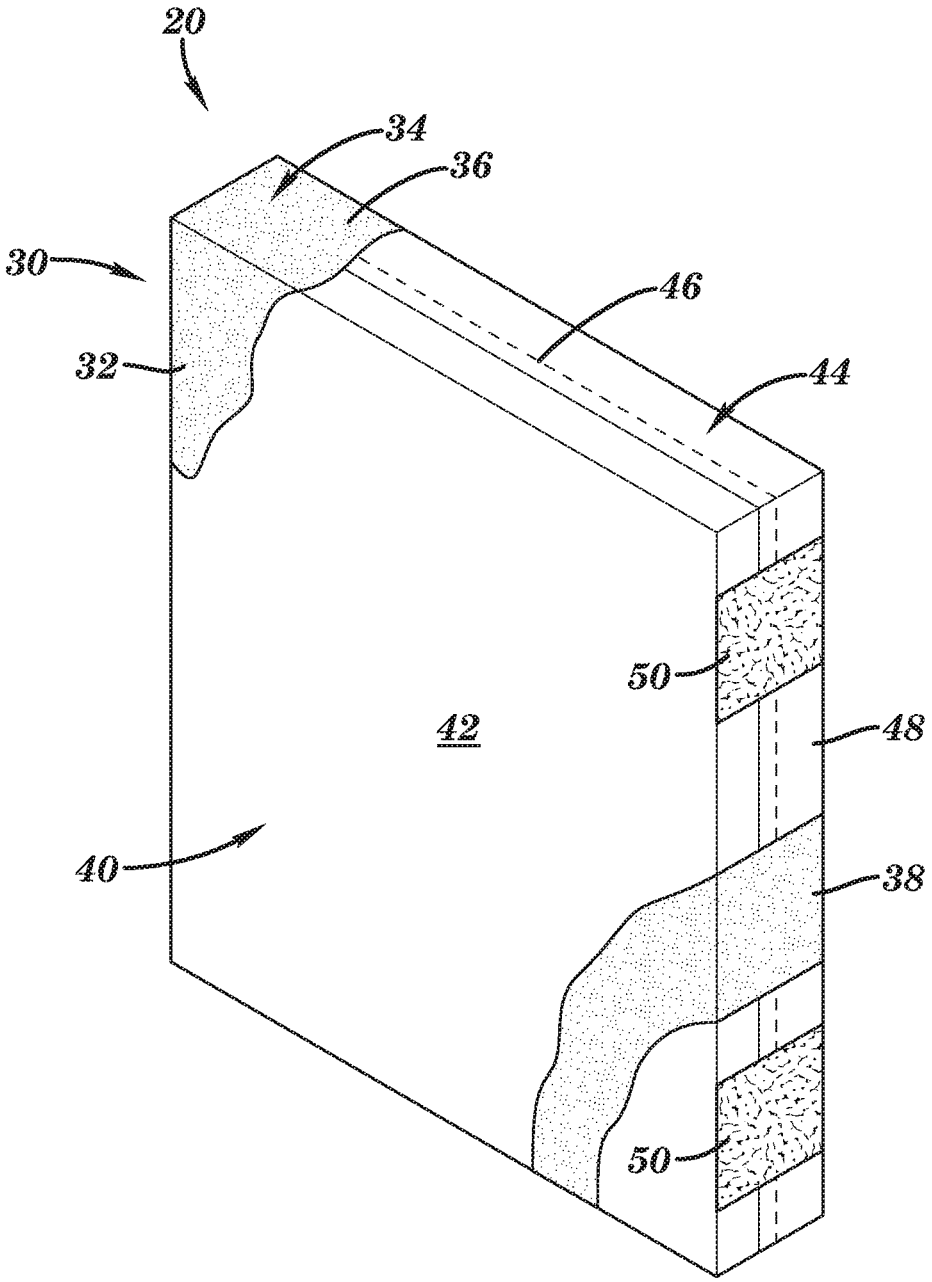
FIG. 4 is an enlarged perspective view, partially cut-away, of the reversible resilient wall pad of the reversible resilient wall padding apparatus of FIG. 3.

As shown in FIG. 4, reversible resilient wall pad 20 may generally include a padded member 30, a cover 40, and a plurality of resilient side connectors 50 (only two of which are shown in FIG. 4).

Padded member 30 may include a main front surface or side 32, a main rear surface or side (not shown in FIG. 4), and a peripherally-extending surface or side 34. Peripherally-extending edge 34 may include a horizontal top side 36, a horizontal bottom side (not shown in FIG. 4), a vertical right side 38, and a vertical left side (not shown in FIG. 4).

In this illustrated embodiment, the padded member may be generally rectangular such as in the form of a cuboid or rectangular prism. The front side and the rear side may be generally evenly spaced apart so that the releasable pad has a generally constant thickness.

Cover 40 may include a first main surface or side 42 and a second main surface or side (not shown in FIG. 4) which extend over the main sides of the padded member, and a peripherally-extending surface or side 44 may include a horizontal top side 46, a horizontal bottom side (not shown in FIG. 4), a vertical right side 48, and a vertical left side (not shown in FIG. 4). The cover may be formed from one or more cover portions. For example, the cover may be formed from two cover portions that extend over respective main portions of the padded member and are attached to each other along the peripherally-extending side. In another embodiment, the cover may be a single cover which is folded or wrapped along a portion of the peripherally-extending side and attached along the remaining portion of the peripheral extending side. For example, portions of the resilient cover may be sewn together along portions that extend along the peripheral extending side. In still other embodiments, the various portions may be attached together along portions of the main first and second sides.

Resilient side connectors 50 may be operable for releasably connecting to pad connectors 60 (FIG. 3). For example, resilient side connectors 50 may be a hook portion or a loop portion of a quick disconnect fasteners such as a hook-and-loop fastener. Resilient side connectors 50 may extend over portions of the peripherally-extending side such as the vertically extending sides of reversible resilient wall pad 20. For example, resilient side connectors 50 maybe disposed adjacent to a top portion of the peripherally-extending side, and adjacent to a bottom portion of the peripherally-extending side. Resilient side connectors 50 may extend the entire thickness of reversible resilient wall pad 20, or extend less that the width of reversible resilient wall pad 20. For example, vertical edges of resilient side connector 50 may be spaced away from the front side and/or the rear side of reversible resilient wall pad 20.

Figure 5:
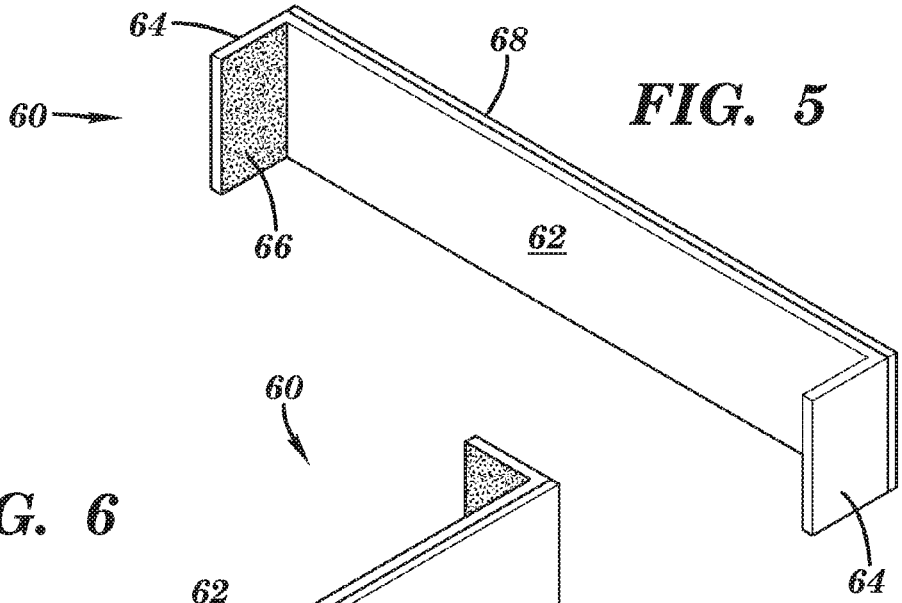
FIGS. 5 and 6 are enlarged perspective views of the pad connector of the reversible resilient wall padding apparatus of FIG. 3.
Figure 6:
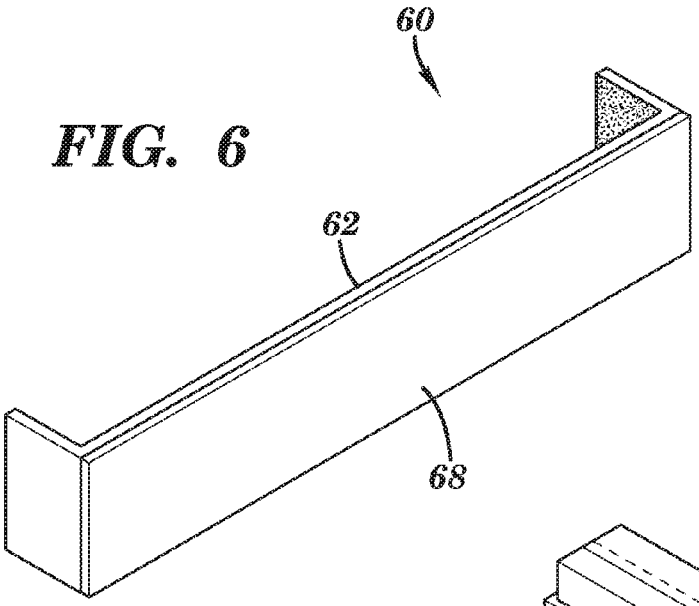

As shown in FIGS. 5 and 6, pad connector strap 60, in one embodiment, may have a generally C-shaped configuration and comprise an elongated member having a main portion 62 sized to extend over a main side of reversible resilient wall pad 20 (FIG. 4), and ends 64 which are sized and configured, and/or flexible, to be positionable at an angle, for example normal or 90 degrees from main side 62, and extend over a portion of the peripherally-extending side of reversible resilient wall pad 20. Inner facing portions of ends 64 may have attached thereto a hook portion or a loop portion 66 (only one shown in FIGS. 5 and 6) of a hook-and-loop fastener so that ends 64 may be releasably attachable to resilient side connector 50 (FIG. 4), e.g., the opposite hook portion or a loop portion disposed on reversible resilient wall pad 20 (FIG. 4). A magnetic strip 68 may be attached along a back side of main portion 62. Main portion 62 and ends 64 of pad connector strap 60 may be formed from a generally thin material sheet or layer, for example, a vinyl material or fabric material. Hook portion or loop portion 66 may be operably attached to end portions 64 of pad connector strap 60 such by sewing or with adhesive, or other suitable attachment means. Magnetic strip 68 may be operably attached to main portion 62 such as retained in a pocket formed by the thin material sheet or layer. The pocket may be sewn to inhibit removal of the magnetic strip from the pocket. Alternatively, the magnetic strip may be attached to the main portion 66 with an adhesive or other suitable attachment means. In other embodiments, the magnetic strip may have other configurations or shapes, such as round or other suitable configurations, and may comprise a single magnetic element or a plurality of magnetic elements. It will be appreciated that the main portion of the pad connectors may be formed from a generally rigid material while the ends are formed from a resilient material. The main portion of the pad connector strap may be sized to extend behind the reversible resilient wall pad when the reversible resilient wall pad is disposed on a vertical surface of a wall.

With reference again to FIG. 3, wall 14 may include wall connectors such as metallic members 16 attached to the vertical surface of wall 14. For example, metallic members 16 may be angle irons embedded in wall 14 such as a concrete wall. In other embodiments, metallic member may be a metal strip such as a steel strip operably attracted to wall such as by bolts or other means. In other embodiments, magnetic members may be disposed in or attached to the vertical surface of wall 14. In some aspects of the disclosure, the metallic member may be disposed in or attached horizontally to the vertical surface of the wall.

Figure 7:
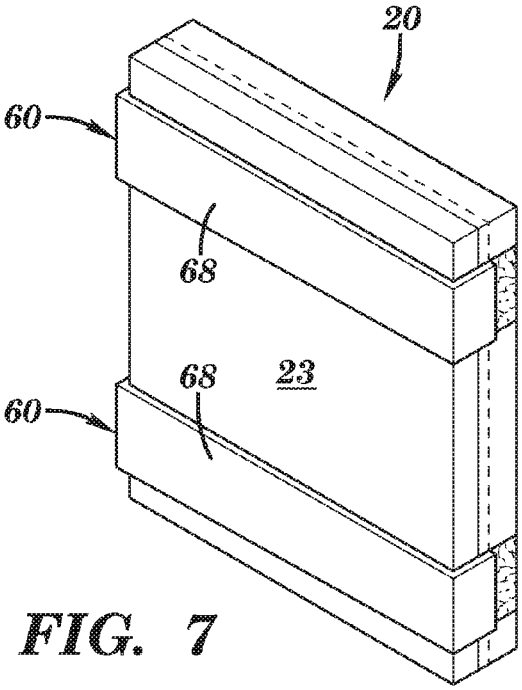
FIG. 7 is a rear perspective view of the reversible resilient wall pad and attached pad connectors of the reversible resilient wall padding apparatus of FIG. 3.

As shown In FIG. 7, pad connector straps 60 may be attachable along a main rear side 23 of reversible resilient wall pad 20. The magnetic strip 68 of the pad connector strap is operably releasably connectable to the metallic member 16 of wall 14 (FIG. 3) to retain reversible resilient wall pad 20 in a fixed position on wall 14. With reference again to FIG. 3, in one embodiment, the vertical height H1 of main portion 62 of pad connector 60 may be greater than the vertical height H2 of the metallic member attached to the wall. Alternatively, the vertical height of the metallic member attached to the wall may be the same or greater than the vertical height of main portion 62 of pad connector strap 60. As will be appreciated, the configuration of the pad connector strap and the metallic members allow for adjusting the vertical positioning the wall pad on the wall. The elongated horizontally extending metallic members also allow for adjustably and movably horizontally positioning the reversible resilient wall pad, and thus, positioning the locations of abutting peripherally-extending sides of the reversible resilient wall pads. The angle iron may be readily installed during forming of the wall, e.g., between layers of bricks or positioned and formed in a concrete form in which the uncured concrete is poured.

Figure 8:
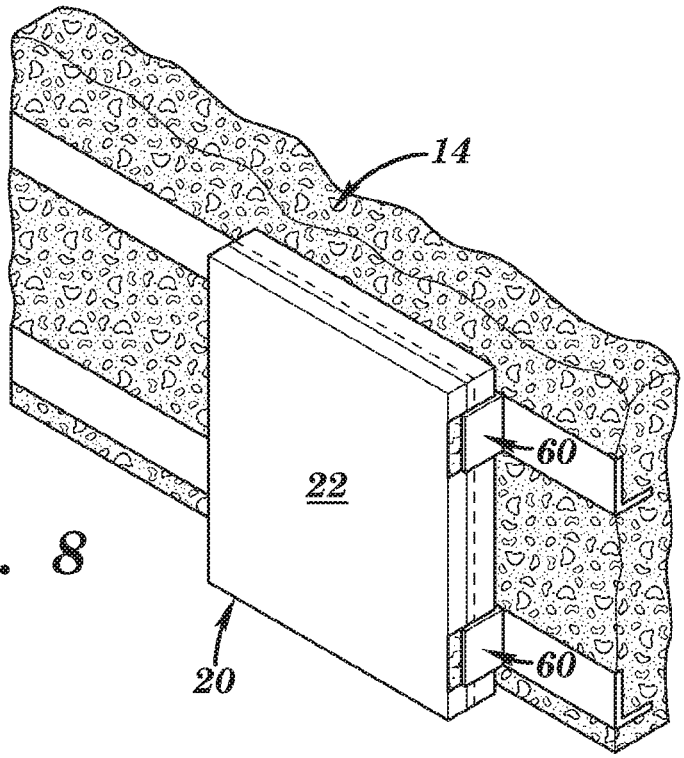
FIG. 8 is a perspective view of the reversible resilient wall pad and the pad connectors of FIG. 3 attached to the vertical surface of the wall with the front side of the reversible resilient wall pad facing outwardly.
Figure 9:
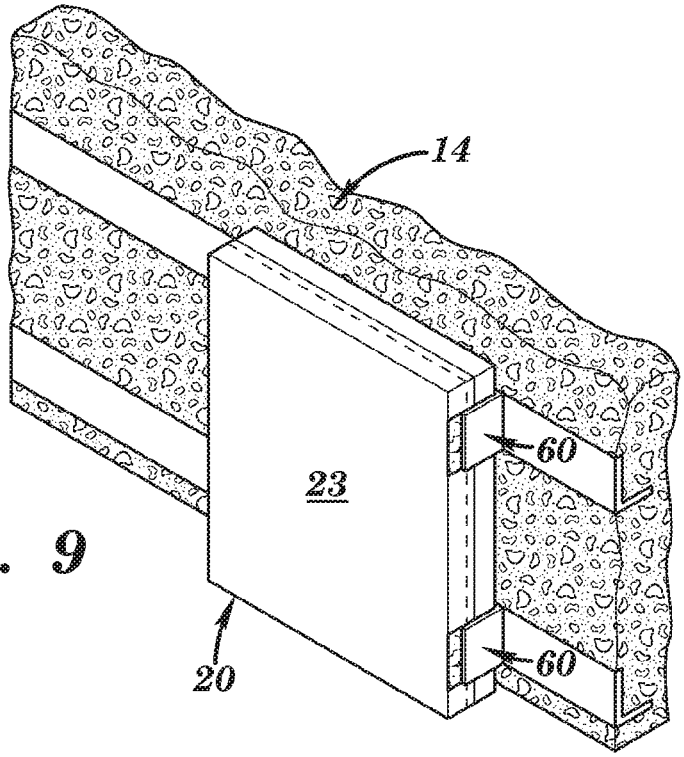
FIG. 9 is a perspective view of the reversible resilient wall pad and the pad connectors of FIG. 3 attached to the vertical surface of the wall with the rear side of the reversible resilient wall pad facing outwardly.

FIG. 8 illustrated reversible resilient wall pad 20 attached to the vertical surface of wall 14 via pad connector 60 with main rear side disposed adjacent to the vertically-extending surface of wall 14, and with main front side 22 of reversible resilient wall pad 20 disposed vertically and facing outwardly. FIG. 9 illustrated reversible resilient wall pad 20 attached to the vertical surface of wall 14 via pad connector 60 with main front side disposed adjacent to the vertically-extending surface of wall 14, and with main rear side 23 of reversible resilient wall pad 20 disposed vertically and facing outwardly.

Figure 10:
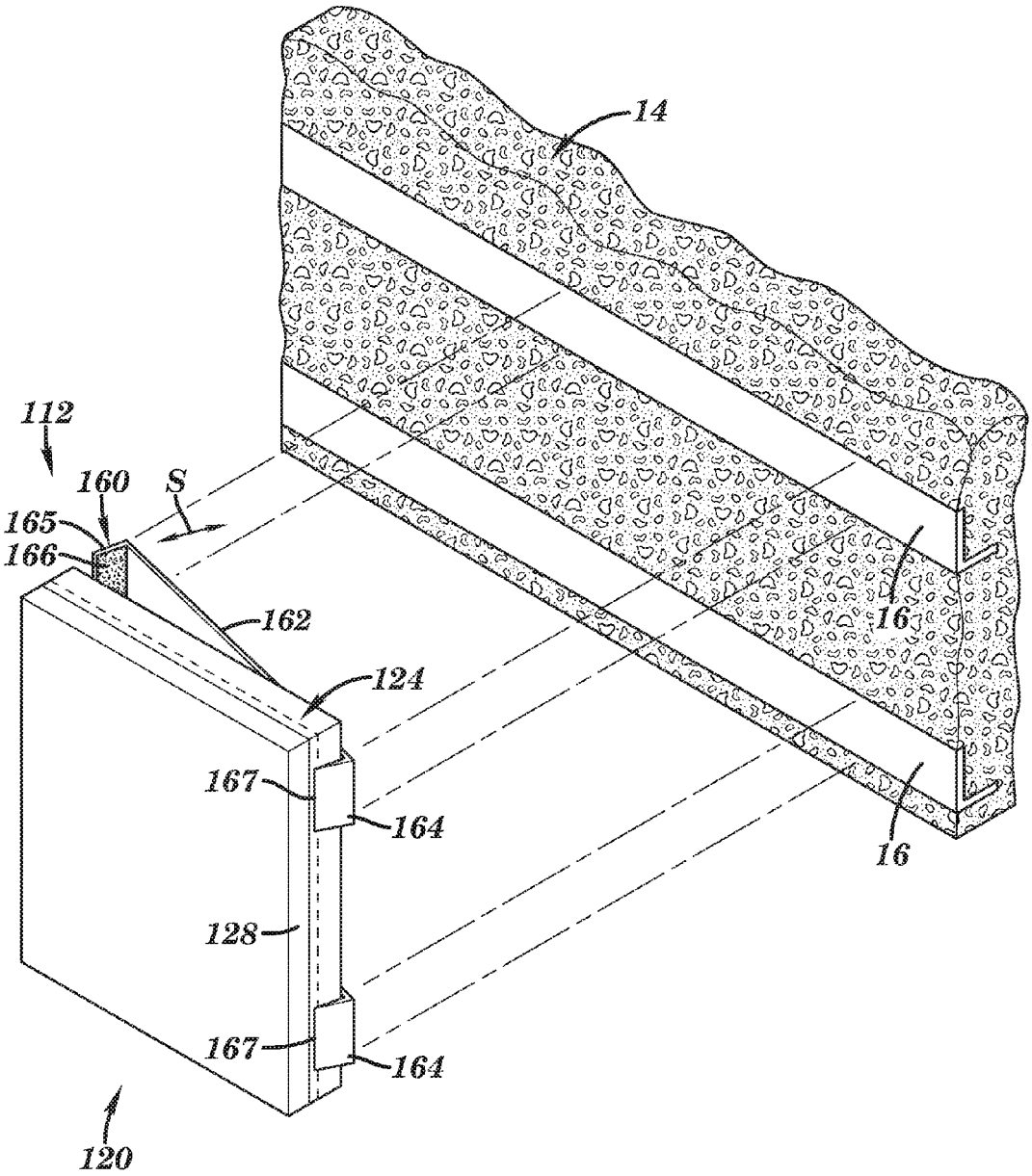
FIG. 10 is an exploded perspective view of another embodiment of a reversible resilient wall padding apparatus, releasably attachable to a vertical surface of a wall, in accordance with aspects of the present disclosure.

FIG. 10 illustrates an exploded view of another embodiment of a reversible resilient wall padding apparatus 112 in accordance with aspects of the present disclosure which generally includes a reversible resilient wall pad 120 and a pad connector 160, which are generally similar to the reversible resilient wall pad 20 (FIG. 3) and pad connector 60 (FIG. 3) described above, with the exception that pad connector 160 may be fixedly attached to reversible resilient wall pad 120.

Pad connector 160, in one embodiment, may generally comprise an elongated member having a first end 164, a main portion 162 sized to extend over a main side portion of reversible resilient wall pad 120, and a second end 165. First end 164 may comprise an edge 167 fixedly attached to reversible resilient wall pad 120. In this illustrated embodiment, an edge 167 may be sewn or otherwise operable attached to reversible resilient wall pad 120 such as sewn or otherwise operably attached to a peripherally-extending side 124. For example, edge 167 may be sewn or otherwise operable attached in the center of a vertical right side 128 of peripherally-extending side 124 of reversible resilient wall pad 120.

In this embodiment, the pad connector may swing about fixed end 164 in the direction of double headed arrow S to be positionable against or adjacent to either the front side or the rear side of the reversible resilient wall pad. It will be appreciated that with this configuration, with the pad connected to the reversible resilient wall pad, the likelihood of the pad connector being misplaced is eliminated.

Pad connector straps 160 may be releasably attachable to the reversible resilient wall pad and also attachable to wall 14. For example, end 165 of pad connector straps 160 may be releasably attachable to reversible resilient wall pad 120 via hook-and-loop fasteners 166, and pad connector straps 160 may be releasably attachable to wall 14 via a magnetic strip magnetically attachable to a wall connector such as an embedded metallic member 16.

For example, first end 164 and second end 165 may be sized and configured, and/or flexible to be positionable at an angle, for example normal or 90 degrees from main side 162, and extend over a portion of the peripherally-extending side of reversible resilient wall pad 120. Inner facing portion of end 165 may have attached thereto a hook portion or a loop portion 166 of a hook-and-loop fastener so that end 165 may be releasably attachable to a resilient side connector (not shown in FIG. 10), e.g., the opposite hook portion or a loop portion disposed on the peripherally-extending side of reversible resilient wall pad 120. The opposite side of end 165 may also include a hook portion or a loop portion (not shown in FIG. 10) of a hook-and-loop fastener so that the opposite side of end 165 may be releasably attachable to the resilient side connector (not shown in FIG. 10) when pad connector strap 165 is flipped around to the opposite main side of reversible resilient wall pad 120. A magnetic strip may be attached along a back side of main portion 162.

Figure 11:
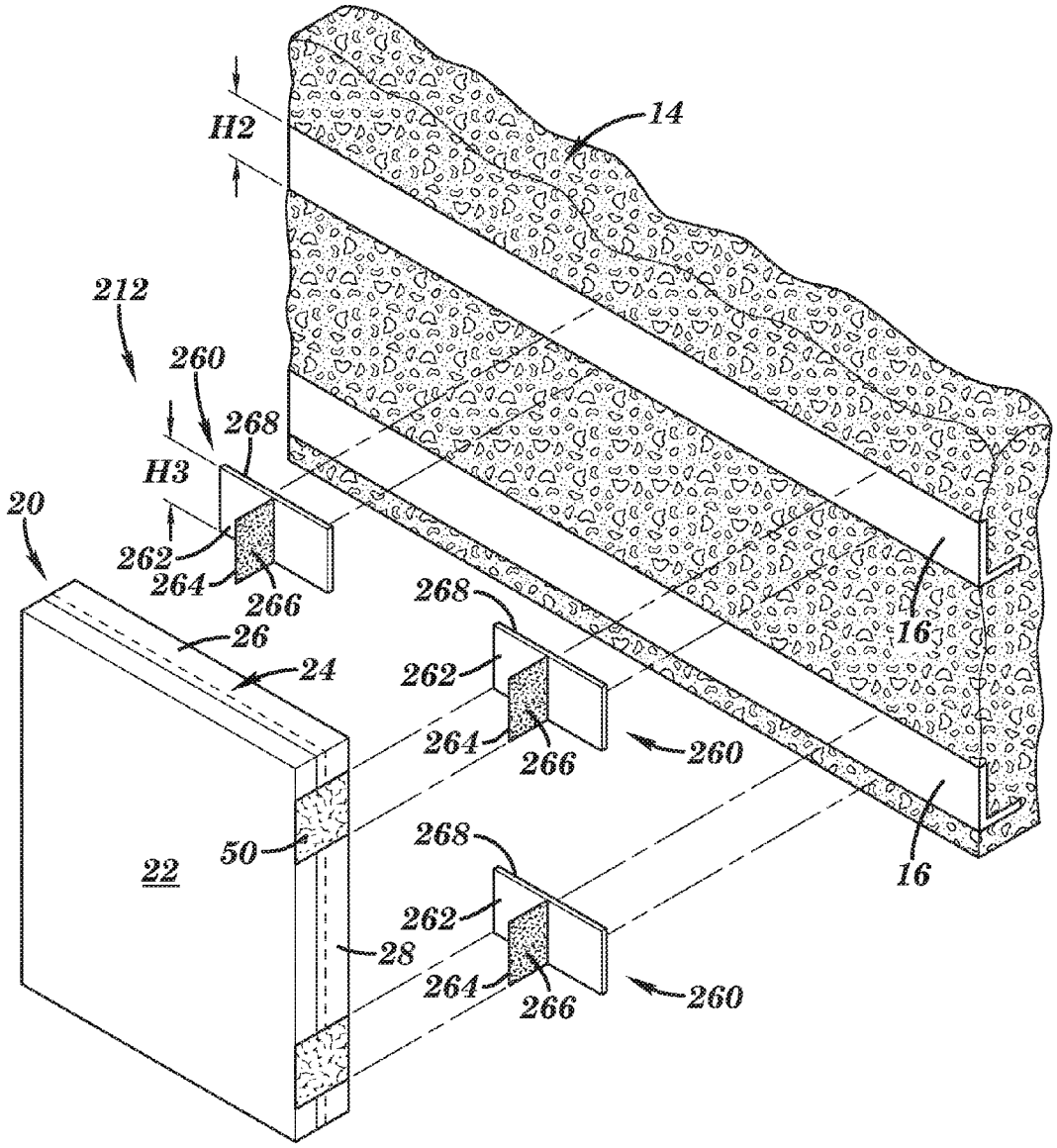
FIG. 11 is an exploded perspective view of another embodiment of a reversible resilient wall padding apparatus, releasably attachable to a vertical surface of a wall, in accordance with aspects of the present disclosure.

FIG. 11 illustrates an exploded view of another embodiment of a reversible resilient wall padding apparatus 212 in accordance with aspects of the present disclosure, which generally includes reversible resilient wall pad 20 such as described above, and a plurality of releasably attachable pad connector tabs 260, such as four pad connector tabs (only three of which are shown in FIG. 11). In this illustrated embodiment, the pad connector tabs are releasably attachable to two adjacent pads (only one pad being shown in FIG. 11) and also attachable to wall 14. For example, pad connector tabs 260 may be releasably attachable to reversible resilient wall pad 20 via hook-and-loop fasteners, and pad connector tabs 260 may be releasably attachable to wall 14 via a magnetic strip to wall connectors such as embedded metallic members 16.

Releasable pad connector tabs 260, in one embodiment, may generally comprise a T-shaped configuration. For example, pad connector tab 260 may include a main portion 262 and an outwardly-extending leg 264 which are sized to be positionable at an angle, for example normal or 90 degrees from main portion 262, and extend over and between side edge portions of two adjacent reversible resilient wall pads 20. The two outer side portions of leg 264 may have attached thereto a hook portion or a loop portion 266 of a hook-and-loop fastener so that leg 264 may be releasably attachable to a first resilient side connector, e.g., the opposite hook portion or a loop portion disposed on reversible resilient wall pad 20, and releasably attachable on the opposite sides to a second resilient side connector, e.g., the opposite hook portion or a loop portion disposed on an adjacent reversible resilient wall pad 20. Main portion 262 and leg 264 of pad connector tab 260 may be formed from a generally thin material sheet or layer, for example, a vinyl material or fabric material. The hook portion or loop portion may be operably attached to end portions of the pad connector tab such by sewing or with adhesive, or other suitable attachment means. The main portion of the pad connector tab may be sized to extend behind one or more adjacent reversible resilient wall pads when the reversible resilient wall pads are disposed on a vertical surface of a wall. From the present discussion, it will be appreciated that in other embodiments, the pad connectors may be L-shaped.

A magnetic strip 268 may be attached along a back side of main portion 262. Magnetic strip 268 may be operably attached to main portion 262 such as retained in a pocket formed by the thin material sheet or layer. The pocket may be sewn to inhibit removal of the magnetic strip from the pocket. Alternatively, the magnetic strip may be attached to the main portion with an adhesive or other suitable attachment means. The exposed magnetic side of the pad connector tab is operably releasably connectable to the metallic member 16 of wall 14 to retain reversible resilient wall pad 20 in a fixed position on wall 14. The vertical height H3 of main portion 262 may be greater than the vertical height H2 of the metallic member attached to the wall. Alternatively, the vertical height of the metallic member attached to the wall may be the same or greater than the vertical height of the main portion of pad connector tab 260. As will be appreciated, the configuration of the pad connector tab and the metallic members allow for adjusting the vertical positioning the wall pad on the wall. The elongated horizontally extending metallic members also allows for adjustably horizontally positioning the pad and thus the location of the seams between the pads. In other embodiments, the magnetic strip may have other configurations or shapes, such as round or other suitable configurations, and may comprise a single magnetic element or a plurality of magnetic elements. It will be appreciated that the main portion of the pad connectors may be formed from a generally rigid material while the ends are formed from a resilient material.

In another embodiment of a reversible resilient wall padding apparatus in accordance with aspects of the present disclosure, one of more pad connector tabs may be fixedly attached to reversible resilient wall pad 20. For example, a distal edge of leg 264 may be sewn or otherwise fixedly attached to reversible resilient wall pad 20. In this configuration, the pad connector may be rotated to either main side of the reversible resilient wall pad for supporting the reversible resilient wall pad with either of the main surfaces facing outwardly. For example, each reversible resilient wall pad 20 may have pad connector tabs 260 fixedly attached to one side of the reversible resilient wall pad, and the other side having just a resilient side connector. When such reversible wall padding apparatus are disposed side-by-side, a connector tab will be disposed between adjacent wall pads.

Figure 12:
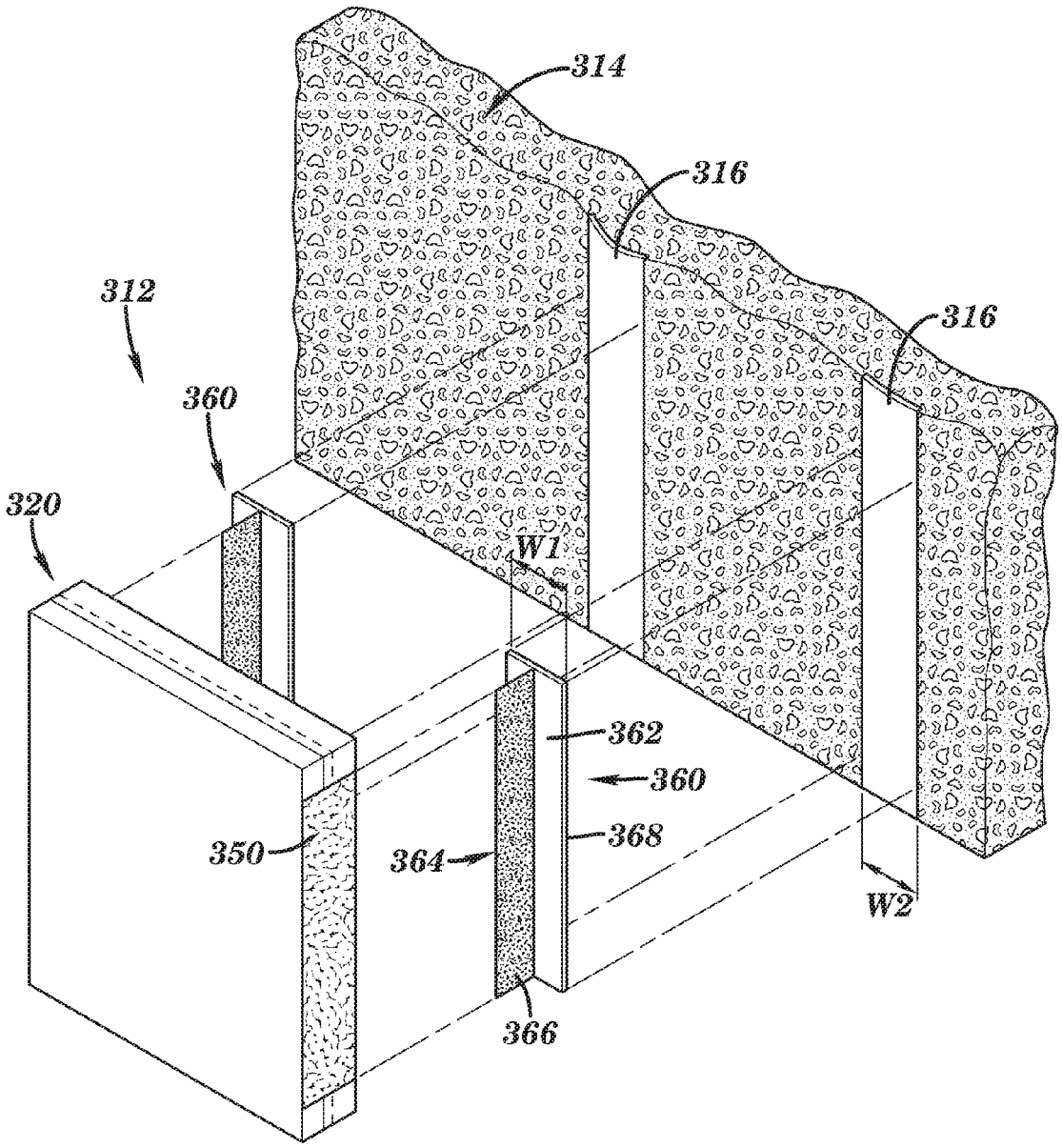
FIG. 12 is an exploded perspective view of another embodiment of a reversible resilient wall padding apparatus, releasably attachable to a vertical surface of a wall, in accordance with aspects of the present disclosure.

FIG. 12 illustrates an exploded view of another embodiment of a reversible resilient wall padding apparatus 312 in accordance with aspects of the present disclosure which generally includes a reversible resilient wall pad 320, and a plurality of releasably attachable pad connector tabs 360. In this illustrated embodiment, the pad connector tabs are releasably attachable to two adjacent pads (only one pad being shown in FIG. 12) and also attachable to a wall 314. For example, pad connector tabs 360 may be releasably attachable to reversible resilient wall pad 320 via hook-and-loop fasteners, and pad connector tabs 360 may be releasably attachable to wall 314 via a magnetic strip to a wall connector such as embedded metallic members 316.

Pad connector tabs 360, in one embodiment, may generally comprise a T-shaped configuration. For example, pad connector tab 360 may include a main portion 362 and an outwardly-extending leg 364 which are sized to be positionable at an angle, for example normal or at 90 degrees from main portion 362, and extend over and between side edge portions of two adjacent reversible resilient wall pads 320. The two outer side portions of leg 364 may have attached thereto a hook portion or a loop portion 366 (only one of which is shown in FIG. 12) of a hook-and-loop fastener so that leg 364 may be releasably attachable to resilient side connector 350, e.g., the opposite hook portion or a loop portion disposed on reversible resilient wall pad 320, and on an opposite side releasably attachable to another resilient side connector, e.g., the hook portion or a loop portion disposed on an adjacent reversible resilient wall pad.

A magnetic strip 368 may be attached along a back side of main portion 362. The exposed magnetic side of the connector tab is operably releasably connectable to metallic member 316 of wall 314 to retain reversible resilient wall pad 320 in a fixed position on the vertical surface of wall 314. The horizontal width W1 of main portion 362 may be greater than the horizontal width W2 of metallic member 316 attached to wall 314. Alternatively, the horizontal width of the metallic member attached to the wall may be the same or greater than the horizontal width of the main portion of connector tab 360. As will be appreciated, the configuration of the connector tab and the metallic members allow for adjusting the vertical and horizontal positioning the reversible resilient wall pad on the vertical surface of the wall. The metallic member may be readily installed during forming of the wall or installing in an existing wall with fasteners such as bolts. Pad connector tabs 360 may be formed from materials and constructed similar to connector tab 260 described above.

In another embodiment of a reversible resilient wall padding apparatus in accordance with aspects of the present disclosure, one of more pad connector tabs may be fixedly attached to a reversible resilient wall pad 320. For example, a distal edge of leg 364 may be sewn or otherwise fixedly attached to reversible resilient wall pad 320. In this configuration, the pad connector may be rotated to either main side of the reversible resilient wall pad for supporting the reversible resilient wall pad with either of the main surfaces facing outwardly. For example, each reversible resilient wall pad 320 may have one pad connector tab 360 fixedly attached to one side, the other side having only a resilient side connector. When such reversible wall padding apparatus are disposed side-by-side, a connector tab will be disposed between adjacent wall pads.

Figure 13:
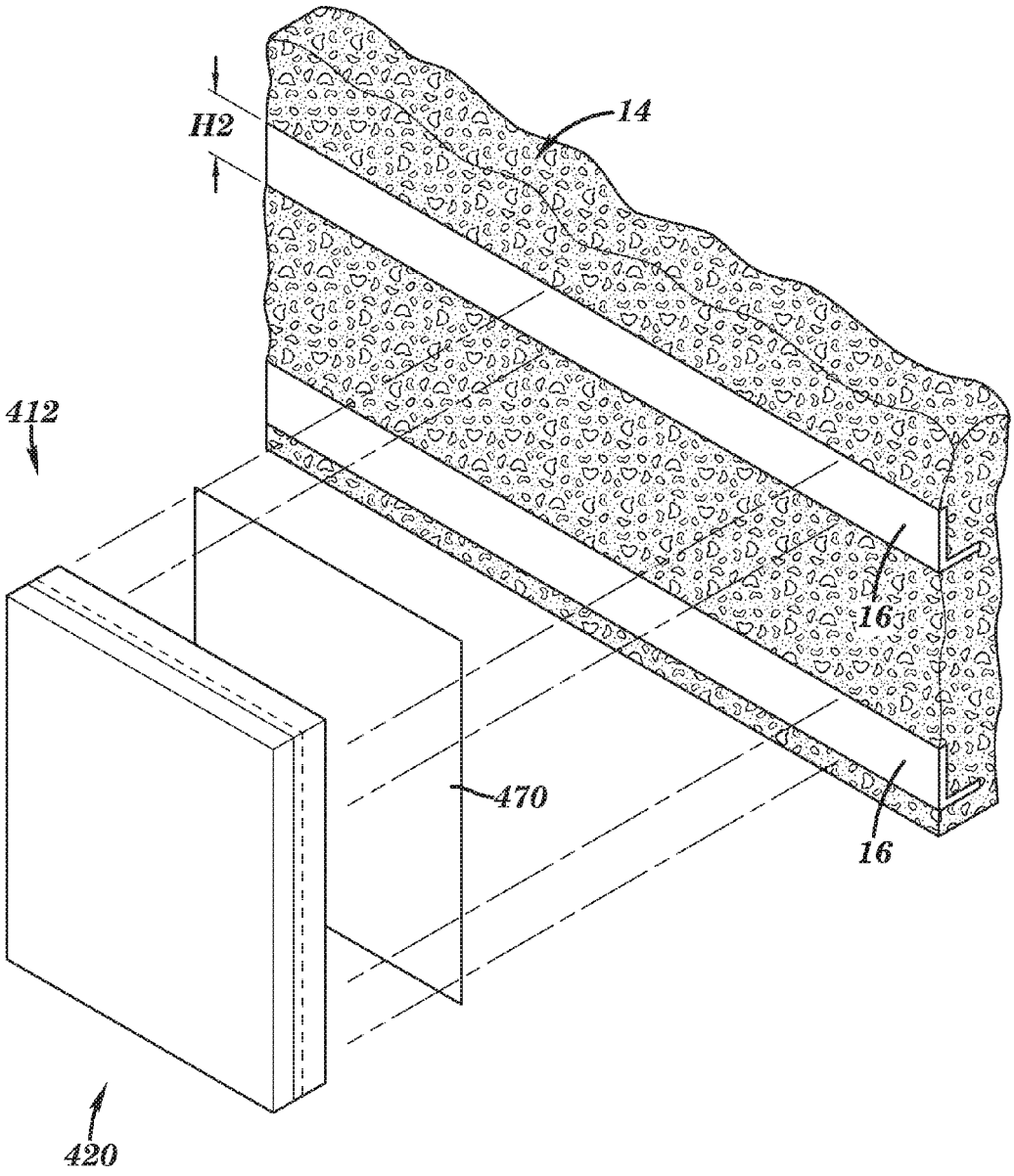
FIG. 13 is an exploded perspective view of another embodiment of a reversible resilient wall padding apparatus, releasably attachable to a vertical surface of a wall, in accordance with aspects of the present disclosure.

FIG. 13 illustrates an exploded view of another embodiment of a reversible resilient wall padding apparatus 412 in accordance with aspects of the present disclosure which generally includes a reversible resilient wall pad 420. In this illustrated embodiment, the reversible resilient wall pad is releasably attachable to a vertical surface of wall 14. For example, as explained below, reversible resilient wall pad may be releasably attachable to wall 14 via a magnetic strip magnetically attachable to a wall connector such as an embedded metallic member 16.

Figure 14:
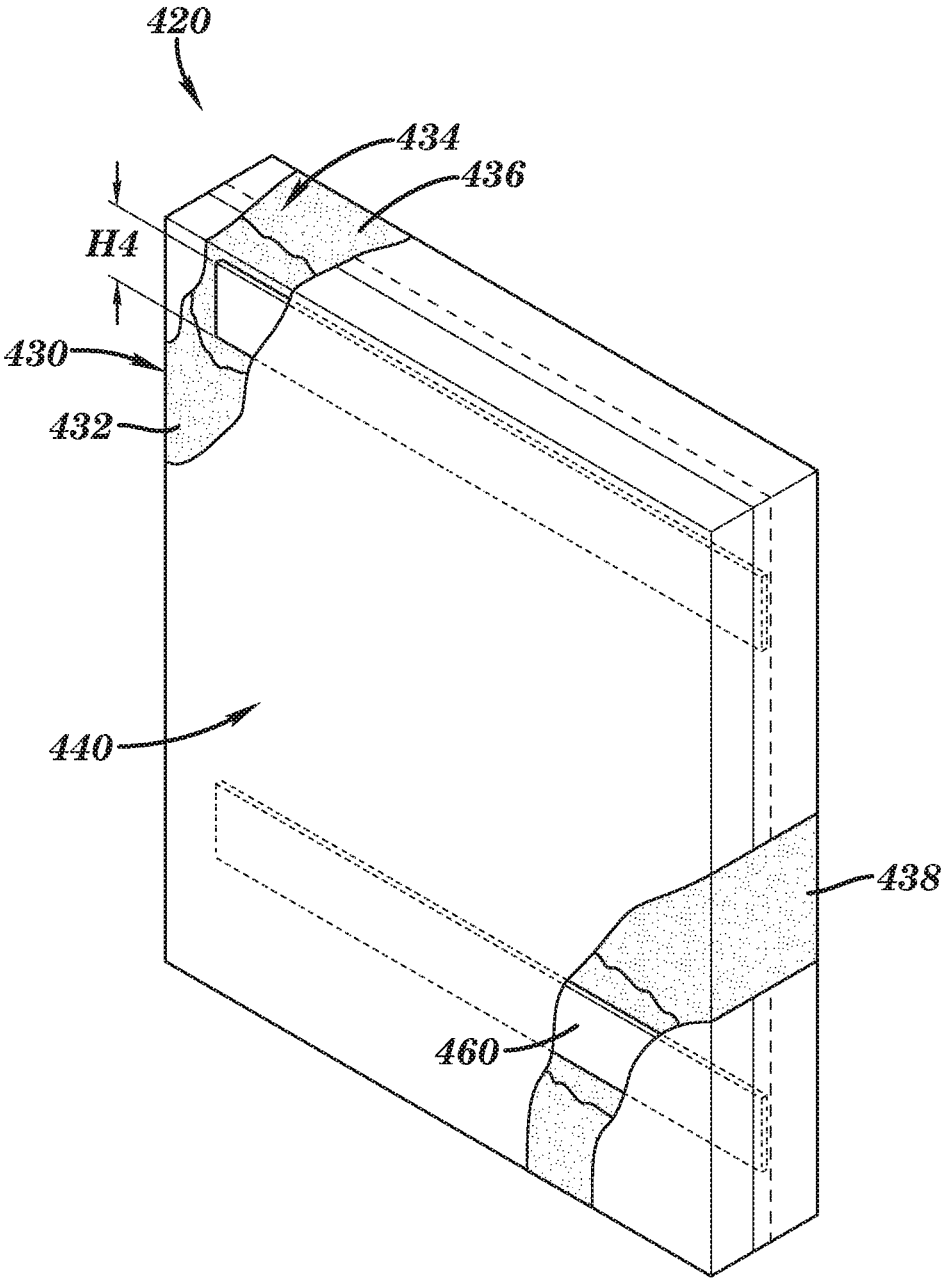
FIG. 14 is an enlarged perspective view, partially cut-away, of the reversible resilient wall pad of the reversible resilient wall padding apparatus of FIG. 13.

As shown in FIG. 14, reversible resilient wall pad 420 may generally include a padded member 430, a resilient cover 440, and at least one magnetic member 460. The magnetic member may be a resilient magnetic member. Padded member 430 may include a main first side 432, a main rear side (not shown in FIG. 14), and a peripherally-extending side 434. Peripherally-extending side 434 may include a horizontal top side 436, a horizontal bottom side (not shown in FIG. 14), a vertical right side 438, and a vertical left side (not shown in FIG. 14).

Magnetic strip 460 may be operably installed in padded member 430. For example, the magnetic strip may be disposed between the front and rear main sides of the padded member. The magnetic strip may be secured or attached to the padded member with, for example, an adhesive. The vertical height H4 of the magnetic strip may be greater than the vertical height H2 (FIG. 13) of the metallic member 16 (FIG. 13) attached to wall 14 (FIG. 13). Alternatively, the vertical height of the metallic member attached to the wall may be the same or greater than the vertical height of the magnetic strip. As will be appreciated, the configuration of the magnetic strip and the metallic members allow for adjusting the vertical and horizontal positioning of the reversible resilient wall pad on the wall. In other embodiments, the magnetic strip may have other configurations or shapes, such as round or other suitable configurations, and may comprise a single magnetic element or a plurality of magnetic elements.

With reference again to FIG. 13, a protective sheet 470 may be disposed between the back of wall pad 420 and the vertical surface of wall 14 to reduce abrasion and/or damage to the main surfaces or sides of the reversible resilient wall pad. The protective sheet may be separate or operably attached to the wall pad.

Figure 15:
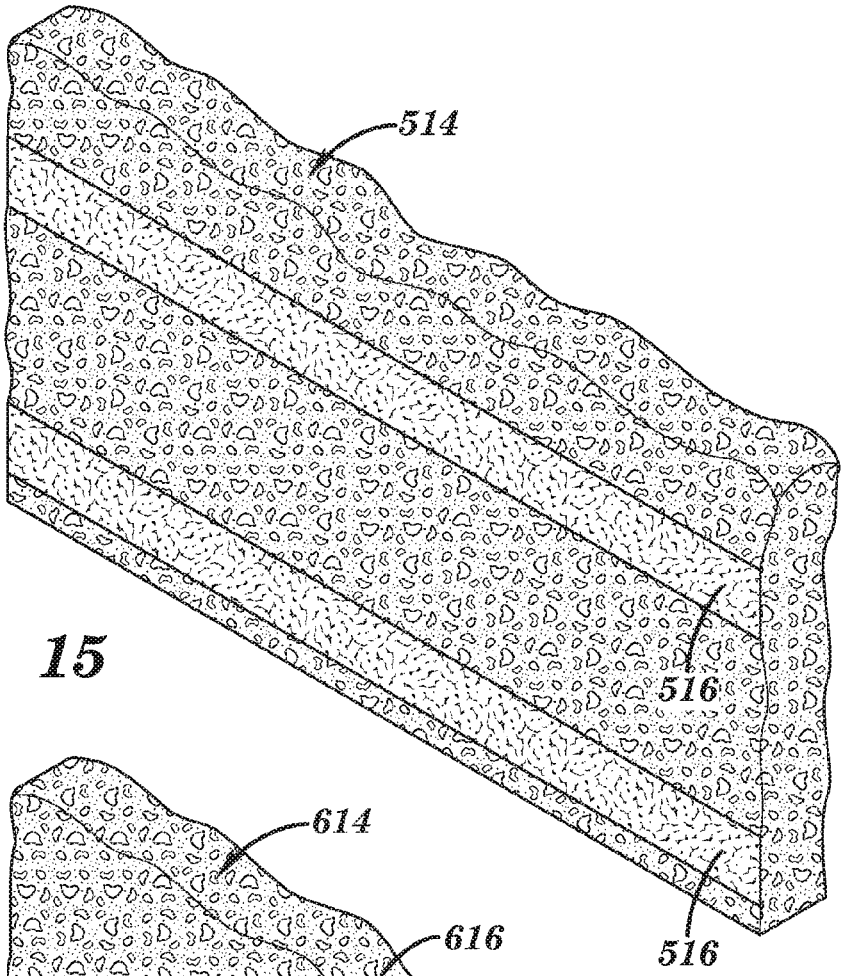
FIGS. 15 and 16 are perspective views of walls in accordance with aspects of the present disclosure.
Figure 16:
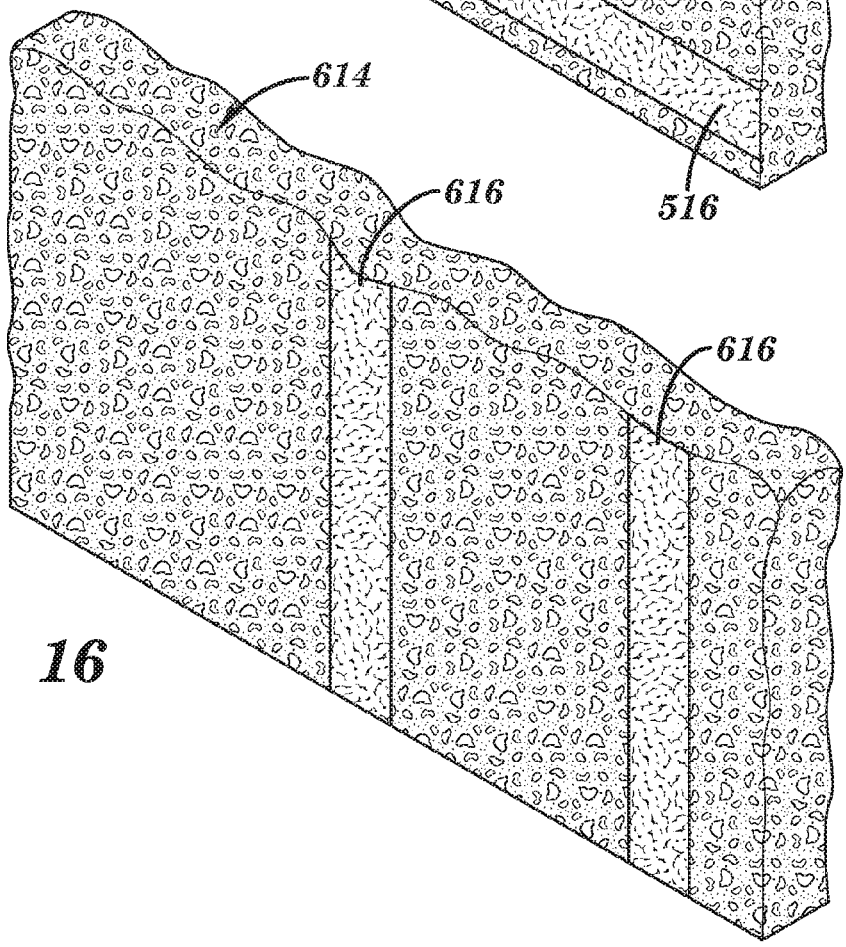

In other embodiments, for example, with reference to FIGS. 3, 10, 11, and 12, the magnetic strip of the pad connectors may be replaced with a hook portion or a loop portion of a hook-and-loop fastener, and the metallic members attached to the wall may be replaced with the other of the loop portion or a hook portion. The hook portion or the loop portion of the hook-and-loop fastener attached to the wall may be disposed horizontally, vertically, or at any suitable angles, or combinations thereof. For example, as shown in FIG. 15, a wall 514 may include a plurality of horizontally-extending hook portion or loop portion 516 of a hook-and-loop fastener. As shown in FIG. 16, a wall 614 may include a plurality of vertically-extending hook portion or loop portion 616 of a hook-and-loop fastener.

Figure 17:
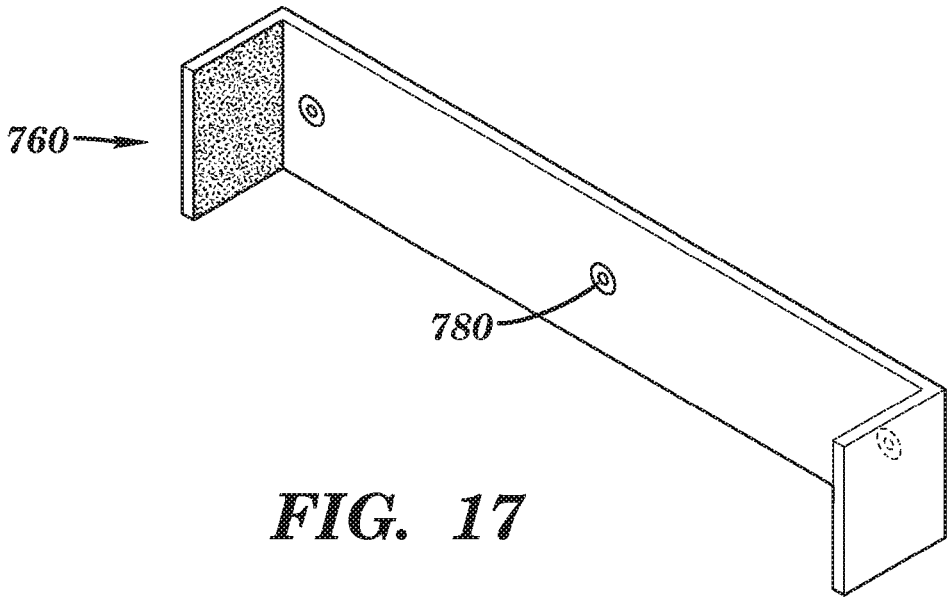
FIG. 17-19 are perspective views of further embodiments of pad connectors in accordance with aspects the present disclosure.
Figure 18:
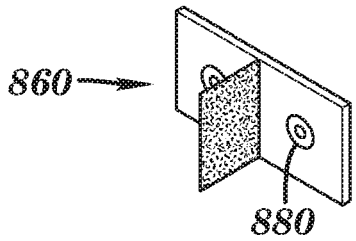
Figure 19:
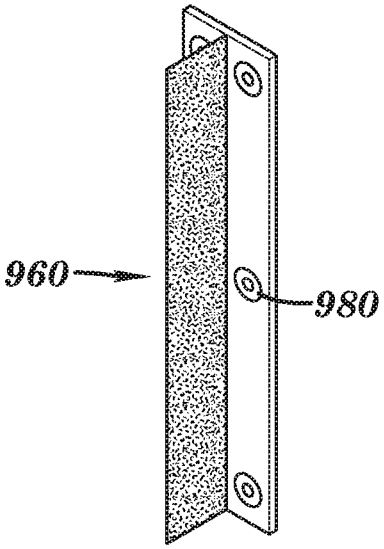

In still other embodiments, for example, with reference to FIGS. 3, 10, 11, and 12, the magnetic strip of the pad connectors may be replaced with holes or grommets extending through the main portion of the pad connector. For example, the grommets may be a ring inserted into a hole through the main portions of the pad connector such as a thin material, fabric, etc. The grommets may be generally flared or collared on each side to keep them in place, and may be made of metal, plastic, or rubber. The grommets may be operable to inhibit tearing or abrasion of the main portion of the pad connector. As shown in FIG. 17, a pad connector 760 may include a plurality of grommets 780. As shown in FIG. 18, a pad connector 860 may include a plurality of grommets 880. As shown in FIG. 19, a pad connector 960 may include a plurality of grommets 980. The pad connectors may be fixedly or releasably attached to a wall with a screw or bolt extending though the grommet such as the screw or bolt being connectable to a threaded sleeve or molly installed in the wall.

Figure 20:
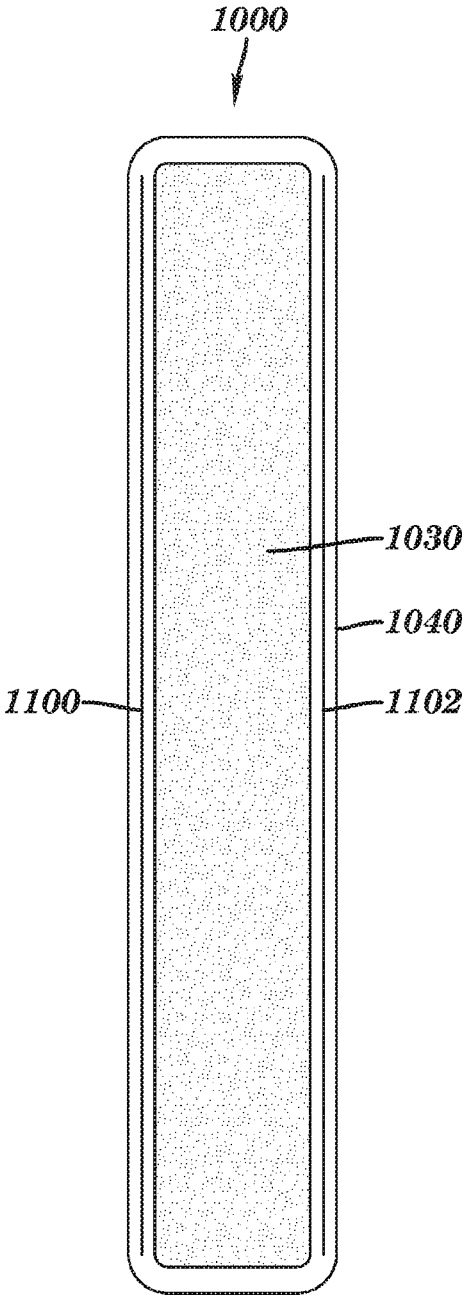
FIGS. 20 and 21 are a cross-sectional views of reversible resilient wall pad in accordance with aspects of the present disclosure.
Figure 21:
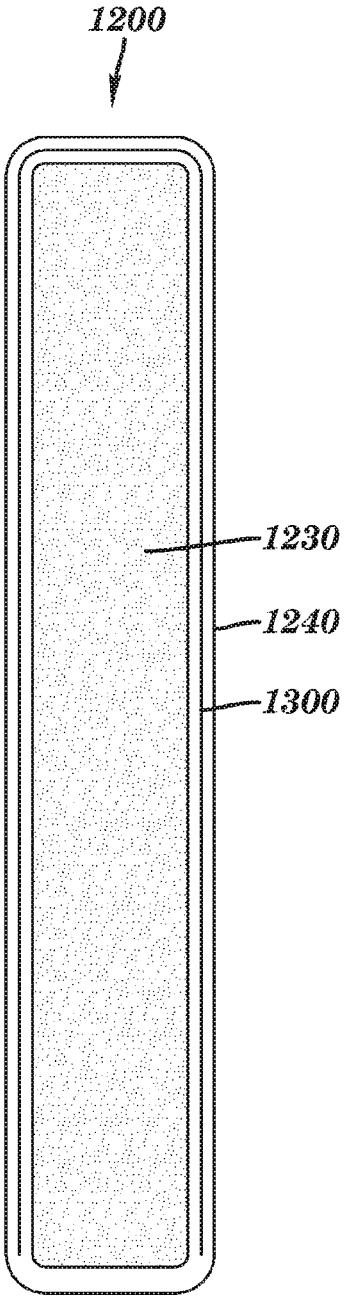

FIGS. 20 and 21 illustrate vertical correctional-views through reversible resilient wall pads 1000 and 1200 in accordance with aspects of the present disclosure. For example, features of reversible resilient wall pads 1000 and 1200 may be incorporated into the above described reversible resilient wall padding apparatus. Reversible resilient wall pad 1000 may includes a padded material 1030, a cover 1040, and reinforcing material layers 1100 and 1102 disposed between the padded material and the cover. For example, reinforcing material layer 1100 may be a scrim material layer, a strong coarse fabric, a durable plain-woven fabric, or other suitable material layer. As shown in FIG. 20, reinforcing material layer 1100 may extend across the main front side of the padded material and the inner surface of the main front side of the cover, and reinforcing material layer 1102 may extend across the main rear side of the padded material and the inner surface of the main rear side of the cover. In this embodiment, two reinforcing material layers may be employed. The reinforcing material layers may be secured or attached to the padded member and/or to the cover with an adhesive or other suitable attachment means. As shown in FIG. 21, reversible resilient wall pad 1200 may includes a padded material 1230, a cover 1240, and a reinforcing material layer 1300. For example, reinforcing material layer 1300 may be a scrim material layer, a strong coarse fabric, a durable plain-woven fabric, or other suitable material layer. Reinforcing material layer 1300 may be draped over the top of the padded material and extend over the front side and the rear side. The draped reinforcing material layer may or may not need to be secured or attached to the padded member and/or to the cover with an adhesive or other suitable attachment means. The reinforcing material layer or layers may provide an anti-tear component to the reversible resilient wall pad, e.g., when baseball outfielders climb the wall to snag a fly ball or homerun ball. For example, when a baseball outfielder digs their cleats into and penetrates the cover such as a vinyl cover, the reinforcing layer reduces the extent of the cover from tearing. In still further embodiments, the wall pad may include a cover having a reinforcing layer. For example, a suitable cover may include an integrally formed reinforcing material layer such as a reinforced vinyl cover.

In other embodiments of the various reversible wall padding apparatus, the portions of resilient side connectors and the pad connectors that attach to the peripherally-extending sides of the reversible resilient sides may have a length that is less than the thickness of the reversible resilient wall pad. With such a configuration, the pad connector will be neither visible nor extend over the outwardly extending main surface or side of the reversible resilient wall pad when the reversible resilient wall pad is attached to a vertical surface of a wall.

In addition, in other embodiments of the various reversible wall padding apparatus, the portions of the resilient side connector and the pad connectors that attach to the peripherally-extending sides of the reversible resilient sides may be resilient and deformable along with the peripherally-extending sides in the event that an athlete contacts, with force, the peripherally-extending side at the location of the resilient side connector and pad connector.

In other embodiments of the various reversible wall padding apparatus, the reversible wall pad may consist solely of a resilient core such as resilient foam, an outer resilient cover, and one or more resilient side connectors, i.e., the reversible wall pad does not comprise a rigid backing.

In still other embodiments of the various reversible wall padding apparatus, the one or more pad connectors may be disposed adjacent to the top and the bottom of the reversible resilient wall pad. In other embodiments, the one or more pad connectors may attach to the reversible resilient wall pad in other locations. For example, the pad connectors may be disposed adjacent to the center of the wall pad. In addition, any number of wall pad connectors may be employed.

In still other embodiments of the various reversible wall padding apparatus, the reversible wall padding may include one or more side connectors that extend around the peripherally-extending side of the reversible wall pad, and the edges of the at least one resilient side connector attach to edges of the cover portions that extend over the front main surface or side and the rear main surface or side of the reversible wall pad. For example, the one or more resilient side connectors may be sandwiched between the front main cover and the rear main cover so that the covers do not extend or extend only over a portion of the peripherally-extending side portions of the wall panel. The front and rear main covers may be formed from a single monolithic piece of material or fabric, or may be formed from two or more monolithic pieces operable connected together. While the reversible resilient wall pads are illustrated as having a resilient core and an outer cover, the reversible resilient wall pads may be formed solely from a resilient core.

While generally rectangular reversible wall padding apparatus are describe and illustrated, it will be appreciated that the teaching of the present disclosure may be applied to other configurations of the reversible wall padding apparatus. While the various reversible resilient wall pads are illustrated and described as having a planar rectangular configuration, it will be appreciated that the reversible resilient wall pads may have other configurations.

The hook-and-loop fasteners employed in the various embodiments may be quick disconnect fasteners. For example, the portions of the resilient side connectors and pad connectors may employ VELCRO brand fasteners.

In the various embodiments, the main portion of pad connectors may be of suitable thickness so as to space the main surfaces or sides of the wall pad away from the vertical surface of the wall, e.g., to provide an air gap between the main surfaces or sides facing the vertical surface or side of the wall and the surface of the wall when the wall pad is installed on the wall.

With the technique of the present disclosure, the reversible resilient wall panels may be easily secured to a wall with the meshing or cooperating engagements of the wall pad, pad connector, and wall connector, and the wall panels may be easily removed from the wall by manually pulling or disconnecting the meshing or cooperating engagements of the pad connector with the resilient pad and/or with the wall connectors. Manual pulling or disconnecting the meshing or cooperating engagements of the pad connector with the reversible resilient wall pad, allows the reversing or flipping around of the pad connector relative to the reversible resilient wall pad, and reconnecting, meshing or engaging the cooperating portions of the pad connector with the reversible resilient wall pad. Thereafter, the reversible resilient wall pad in the reversed orientation may be reinstalled on the wall by reconnecting, meshing or engaging the cooperating portions of the pad connector and the wall.

Where the wall connector is fixedly attached to the wall, manual pulling or disconnecting the meshing or cooperating engagements of the pad connector with the reversible resilient wall pad, allows the reversing or flipping around of the resilient wall pad relative to wall, and thereafter, reconnecting, meshing or engaging the cooperating portions of the pad connector with the resilient wall pad.

For stadium padding, the pad maybe about 4-inches thick, about 4-feet wide, and between about 2-feet and about 10-feet high. The vertical sides of the reversible resilient wall padding apparatus are typically disposed adjacent to another reversible resilient wall padding apparatus when installed, for example, in a stadium.

The padded member may be formed from an expanded polyethylene (EPE) or other suitable foam or resilient material. For example, the padded member may be a 1.3 pounds per cubic foot ARPAK expanded polyethylene available from JSP Corporation. Desirably, the padded foam has sufficient rigidity so that the pad is supported without sagging, and not requiring a rigid backing board. The padded member may be formed from one-piece for may be formed from a plurality of pieces. For example, the padded member may comprise a single layer, or may comprise a plurality of layers. The layers may comprise the same material or may be formed from a plurality of different materials. For example, the padded member may comprise an inner layer and two outer layers, and the inner layer may have greater rigidity than the outer layer, e.g., the outer layers being more resilient than the inner layer. The thicknesses of the layers may be different. For example, the inner layer may be thinner than the outer layers, or the inner layer may be thicker than the outer layers.

The cover may be a resilient cover fabricated from a material or fabric which is stretchable (e.g., having a greater than 50-percent stretch, and desirably greater than 100-percent) in 4 directions and/or in 360-degrees. Desirably the material is able to retain its shape and return back to its original structure after being stretched. The material may also include a high UV protection as well as TEFLON coating for water resistance. When pre-tensioning the resilient cover, the resilient cover may be stretched about or greater than 10-percent, 20-percent, 40-percent, or greater over its normal unstretched size.

One suitable stretchable material is sold under the trademark ALLSPORT 4-Way Stretch Vinyl manufactured and available from Morbern, Inc. of Cornwall, Ontario, Canada. For example, the ALLSPORT material has a nominal total thickness of 0.040±0.005 inches (45±5 mils), a standard weight of 32.25±1.5 ounces per linear yard, and greater than 100-percent stretch in both directions. LYCRA and SPANDURA, and combinations with other materials, may also be configured to stretch in 4 directions. It will also be appreciated by those skilled in the art that any other suitable material having 4-way expansion/contraction capabilities may be employed in forming the resilient cover.

In other embodiments, the padded member may be formed from polyurethane such as expanded polypropylene (EPP), expanded polyethylene (EPE), fused beaded EPE foam, or other foam or resilient material for providing protection to, for example, an athlete upon contact with the reversible resilient wall padding.

In other embodiments, the cover may be a vinyl cover such as a high ultraviolet (UV) 16-ounce or 25-ounce laminated or coated vinyl. In still other embodiments, the cover may be water impermeable or not permitting the passage of water to the padded core.

In further embodiments, due to the materials forming the padded member and the cover, the padded member likely comprises a first coefficient of thermal expansion (e.g., linear thermal expansion, area thermal expansion, and/or volumetric thermal expansion) and the cover likely comprises a second coefficent of thermal expansion (linear thermal expansion, area thermal expansion, and/or volumetric thermal expansion) which is different from the first coefficient of thermal expansion. Thus, a change in temperature may cause a wrinkling in the cover. In some aspects of the present disclosure, the resilient cover may be integrated into the apparatus in a pre-tensioned manner to ensure that when the temperature drops the resilient cover is drawn tight to the face of the apparatus. Conversely, when the temperature increases the resilient cover allows the resilient cover to expand with the growth of the apparatus. The present disclosure eliminates the wrinkling and sagging problem without impacting the primary functioning of the reversible resilient wall padding. For example, the pre-tensioning inhibits the likelihood of wrinkles appearing on the cover as the cover and the padded member expand and contract over a change of temperatures between about 30-degrees Fahrenheit to about 40-degrees Fahrenheit in a few hours, and desirably between about 40-degrees Fahrenheit and 50-degrees Fahrenheit in a few hours.

As suitable magnetic material may include rare earth type magnets operable, for example, for holding the pad in place. Alternatively, suitable magnetic material may include a flexible magnetic material operable, for example, for holding the pad in place. It will be appreciated that other high energy, magnets may be operably employed to hold the pad in place.

From the present disclosure, it will be appreciated that the reversible resilient wall padding apparatus allows use of the reversible resilient wall padding apparatus with either main side facing outwardly. Thus, the backing board and Z-shaped clips attached to and extending horizontally across rear side of backing board found in conventional wall padding may be eliminated.

From the present description, it will be appreciated that while a wall such as a concrete or brick wall has been described, it will be appreciated that the wall may be a fence such as a chain link fence or other suitable structure having a vertically-extending surface, and the reversible resilient wall padding apparatus may be operably attachable to the vertically-extending surface of the fence, chain link fence, or other suitable structure. For example, the pad connectors may be operably attached or attachable to the fence or chain link fence.

Figure 22:
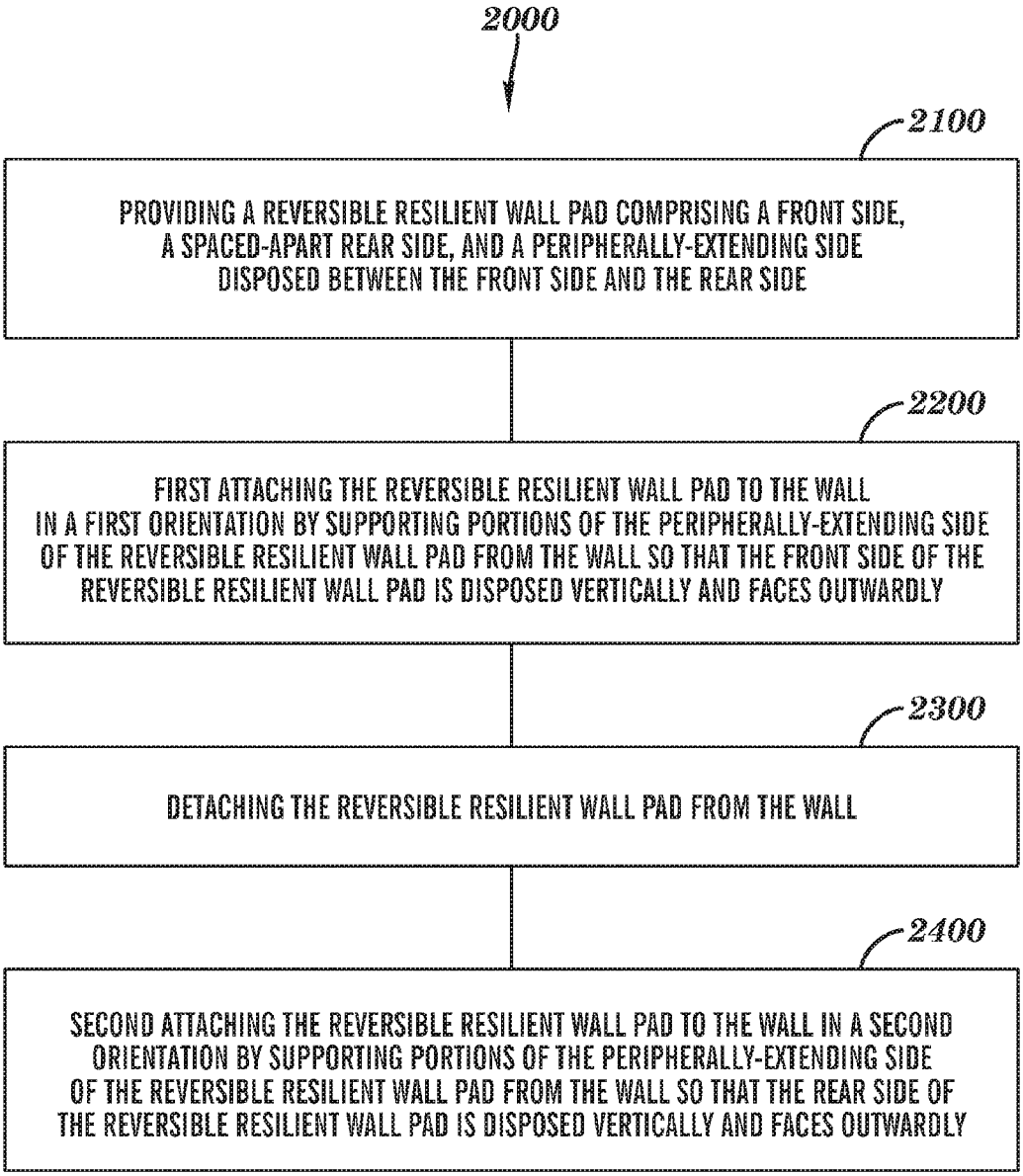
FIG. 22 is a flowchart of one embodiment of a method for releasably attaching a reversible resilient wall padding apparatus to a wall in accordance with aspects the present disclosure.

FIG. 22 illustrates a flowchart describing one embodiment of a method 2000 for releasably attaching a reversible resilient wall padding apparatus to a vertical surface of a wall. The method may include at 2100, providing a reversible resilient wall pad comprising a front side, a spaced-apart rear side, and a peripherally-extending side disposed between the front side and the rear side. At 2200, the reversible resilient wall pad is first attached to the wall in a first orientation by supporting portions of the peripherally-extending side of the reversible resilient wall pad from the wall so that the front side of the reversible resilient wall pad is disposed vertically and faces outwardly. At 2300, the reversible resilient wall pad is detached from the wall, and at 2400, the reversible resilient wall pad is attached to the wall in a second orientation by supporting portions of the peripherally-extending side of the reversible resilient wall pad from the wall so that the rear side of the reversible resilient wall pad is disposed vertically and faces outwardly.

While the above reversible resilient wall padding apparatus of the present disclosure may be operably employed outdoor such as in outdoor stadiums or other outdoor locations, from the present description it will be appreciated that reversible wall padding apparatus of the present disclosure may be operably employed indoors such as in indoor gymnasiums or other indoor locations. Further, the techniques of the present disclosure may be applicable to reversible wall panels that may be resilient, rigid, or combinations thereof.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A reversible wall padding apparatus releasably attachable to a wall for protecting athletes from the wall, said reversible wall padding apparatus comprising:

a reversible wall pad comprising a padded front side, a spaced-apart padded rear side, and a peripherally-extending side disposed between said padded front side and said padded rear side; and at least one connector attached or attachable to a vertical portion of said peripherally-extending side of said reversible wall pad;

wherein said at least one connector is operable to connect the vertical portion of said peripherally-extending side of said reversible wall pad to the wall in:

a first orientation with said padded front side of said reversible wall pad facing outwardly from a surface of the wall for protecting athletes upon contact by the athletes with said padded front side of said reversible wall pad; and a second orientation with said padded rear side of said reversible wall pad facing outwardly from the surface of the wall for protecting athletes upon contact by the athletes with said padded rear side of said reversible wall pad.

2. The reversible wall padding apparatus of claim 1 wherein said reversible wall pad comprises a resilient cover surrounding a foam material.

3. The reversible wall padding apparatus of claim 2 wherein said resilient cover comprises a vinyl cover.

4. The reversible wall padding apparatus of claim 1 wherein said reversible wall pad consists of an outer cover surrounding a foam core.

5. The reversible wall padding apparatus of claim 1 wherein said at least one connector solely supports said peripherally-extending side of said reversible wall pad from the wall in said first orientation and in said second orientation.

6. The reversible wall padding apparatus of claim 1 wherein said at least one connector does not extend over said outwardly facing padded front side when said reversible wall pad is disposed in said first orientation, and wherein said at least one connector does not extend over said outwardly facing padded rear side when said reversible wall pad is disposed in the first said second orientation.

7. The reversible wall padding apparatus of claim 1 wherein said at least one connector being spaced away from said padded front side of said reversible wall pad when said reversible wall padding apparatus is disposed in said first orientation, and wherein said at least one connector being spaced away from said padded rear side of said reversible wall pad when said reversible wall padding apparatus is disposed in said second orientation.

8. The reversible wall padding apparatus of claim 1 wherein at least a portion of said at least one connector is fixedly attached to said reversible wall pad.

9. The reversible wall padding apparatus of claim 1 wherein said at least one connector comprises at least one resilient connector.

10. The reversible wall padding apparatus of claim 1 wherein said at least one connector comprises at least one portion of a hook-and-loop fastener.

11. The reversible wall padding apparatus of claim 1 wherein said at least one connector comprises a magnet.

12. The reversible wall padding apparatus of claim 1 wherein said at least one connector comprises at least one of a hole and a grommet.

13. The reversible wall padding apparatus of claim 1 wherein said reversible wall pad comprises a thickness of about 4-inches, a width of about 4-feet, and a height between about 2-feet and about 10 feet.

14. An outdoor wall panel system comprising:

a plurality of reversible wall padding apparatus of claim 1 disposed generally side-by-side along a field of an outdoor stadium.

15. The outdoor wall panel system of claim 14 further comprising a wall having a plurality of wall connectors operably connectable to said connectors.

16. The outdoor wall panel system of claim 15 wherein said plurality of wall connectors comprise a plurality of elongated metallic members.

17. A method of protecting athletes in an outdoor stadium, the method comprising:

providing a plurality of reversible wall padding apparatus of claim 1 disposed side-by-side along a field of an outdoor stadium.

18. A method comprising:

providing a reversible wall pad comprising a padded front side, a spaced-apart padded rear side, and a peripherally-extending side disposed between the padded front side and the padded rear side;

first attaching, with at least one connector attached or attachable to a vertical portion of the peripherally-extending side of the reversible wall pad, the vertical portion of the peripherally-extending side of the reversible wall pad to a wall in a first orientation from the wall so that the front side of the reversible wall pad is disposed vertically and faces outwardly;

protecting athletes upon contact by the athletes with the padded front side of the reversible wall pad;

detaching the reversible wall pad from the wall;

second attaching, with the at least one connector attached or attachable to the vertical portion of the peripherally-extending side of the reversible wall pad, the vertical portion of the peripherally-extending side of the reversible wall pad to the wall in a second orientation from the wall so that the padded rear side of the reversible wall pad is disposed vertically and faces outwardly; and protecting athletes upon contact by the athletes with the padded rear side of the reversible wall pad.

19. The method of claim 18 wherein the reversible wall pad comprises a resilient cover surrounding a foam material.

20. The method of claim 19 wherein the resilient cover comprises a vinyl cover.

21. The method of claim 18 wherein the reversible wall pad consists of an outer cover surrounding a foam core.

22. The method of claim 18 wherein the first attaching comprises solely supporting the peripherally-extending side of the reversible wall pad from the wall, and the second attaching comprises solely supporting portions of the peripherally-extending side of the reversible wall pad from the wall.

23. The method of claim 18 wherein the wall comprises an outdoor wall, the first attaching comprises first attaching the reversible wall pad to the outdoor wall in the first orientation from the outdoor wall so that the front side of the reversible wall pad is disposed vertically and faces outwardly, and the second attaching comprises second attaching the reversible wall pad to the outdoor wall in the second orientation from the outdoor wall so that the rear side of the reversible wall pad is disposed vertically and faces outwardly.

24. The method of claim 18 wherein the reversible wall pad comprises a thickness of about 4-inches, a width of about 4-feet, and a height between about 2-feet and about 10 feet.

25. The reversible wall padding apparatus of claim 1 wherein said at least one connector is operable to adjust vertically the position of said reversible wall padding apparatus on the wall.

26. The reversible wall padding apparatus of claim 1 wherein said at least one connector is operable to adjust horizontally the position of said reversible wall padding apparatus on the wall.

27. The method of claim 18 wherein the first attaching comprises adjusting the vertical position of the reversible wall padding apparatus on the wall, and the second attaching comprises adjusting the vertical position of the reversible wall padding apparatus on the wall.

28. The method of claim 18 wherein the first attaching comprises adjusting the horizontal position of the reversible wall padding apparatus on the wall, and the second attaching comprises adjusting the horizontal position of the reversible wall padding apparatus on the wall.

* * * * *